US006546577B1

(12) United States Patent
Chinn

(10) Patent No.: US 6,546,577 B1
(45) Date of Patent: Apr. 15, 2003

(54) MOBILE MEDICAL EMERGENCY AND SURGICAL TABLE

(76) Inventor: James Chinn, 49 Thompson Pl., Roswell, GA (US) 30075

( * ) Notice: Subject to any disclaimer, the term of this patent is extended or adjusted under 35 U.S.C. 154(b) by 42 days.

(21) Appl. No.: 09/708,094

(22) Filed: Nov. 7, 2000

Related U.S. Application Data

(60) Provisional application No. 60/164,299, filed on Nov. 8, 1999.

(51) Int. Cl.[7] ..... A61G 13/00

(52) U.S. Cl. ..... 5/600; 5/611; 5/503.1; 5/658; 5/308; 5/620

(58) Field of Search ..... 5/600, 620, 503.1, 5/658, 8.1, 9.1, 606, 611, 308

(56) References Cited

U.S. PATENT DOCUMENTS

| | | | | |
|---|---|---|---|---|
| 2,022,714 A | * | 12/1935 | Gallup | 5/606 |
| 3,188,659 A | * | 6/1965 | Lundgren et al. | 5/86.1 |
| 4,019,772 A | | 4/1977 | Lee | |
| 4,270,234 A | | 6/1981 | James | |
| 4,352,991 A | | 10/1982 | Kaufman | |
| 4,451,944 A | | 6/1984 | James | |
| 4,584,989 A | | 4/1986 | Stith | |
| 4,685,160 A | * | 8/1987 | Rizzardo | 5/201 |
| 4,767,148 A | | 8/1988 | Ferneau et al. | |
| 4,768,241 A | | 9/1988 | Beney | |
| 4,819,925 A | * | 4/1989 | Linnemann et al. | 5/606 |
| 4,921,295 A | | 5/1990 | Stollenwerk | |
| 4,953,886 A | | 9/1990 | Mitchell | |
| 4,957,121 A | | 9/1990 | Icenogle et al. | |
| 5,005,230 A | * | 4/1991 | Congdon | 5/308 |
| 5,095,562 A | * | 3/1992 | Alexander | 5/611 |
| H1328 H | | 7/1994 | Horton et al. | |
| 5,375,276 A | | 12/1994 | Nelson et al. | |
| 5,497,766 A | | 3/1996 | Foster et al. | |
| 5,572,756 A | | 11/1996 | Muuranen et al. | |
| 5,819,339 A | | 10/1998 | Hodgetts | |
| 5,918,331 A | | 7/1999 | Hall et al. | |
| 5,987,671 A | | 11/1999 | Heimbrock et al. | |
| 5,991,947 A | | 11/1999 | Lavin et al. | |

FOREIGN PATENT DOCUMENTS

| | | | |
|---|---|---|---|
| GB | 1514753 | * | 6/1978 |

* cited by examiner

*Primary Examiner*—Michael F. Trettel

(57) ABSTRACT

A mobile medical emergency and surgical table that comprises a frame assembly, a pair of mechanically advantaged undercarriage assemblies having wheels, a plurality of stretcher yoke assemblies, a plurality of preferably uniformly dimensioned and interchangeable storage cassettes, an electrical subsystem, and a plurality of optional mounts for the attachment of medical and surgical equipment.

69 Claims, 27 Drawing Sheets

MOBILE MEDICAL EMERGENCY AND SURGICAL TABLE

RELATED APPLICATIONS

The inventor hereof claims priority pursuant to United States Provisional Patent Application Ser. No. 60/164,299, filed on Nov. 8, 1999.

FIELD OF THE INVENTION

The present invention relates generally to a mobile medical emergency table; and, more particularly, to a mobile medical emergency table that may be specifically and suitably fitted, configured, and placed for immediate field-based surgical use and intervention in the case of a medical emergency. The present invention provides, among other things, stable, yet adjustable, independent latching means to accommodate an emergency stretcher; a mechanically advantaged undercarriage for optionally placing the table into a fixed position and location; removable and interchangeable storage cassettes for equipment and supplies; and, a variety of other such features and advantages as enable the invention to fulfill its intended purpose.

BACKGROUND OF THE INVENTION

In a medical emergency, a relatively few minutes can mean the difference, in some cases, between life and death. In other cases, the same few minutes can mean the difference between a relatively full recovery and a life of impairment and disability. In fact, the first hour following a medical trauma is sometimes called the "golden hour". If medical intervention is not provided within this hour, the patient likely will not fully recover or will perish. The import of such truisms are especially accurate when considering those who have been affected in large scale disasters.

In times of disaster, especially in the aftermath of tornadoes, earthquakes, and other natural disasters, airliner, train, and large scale automobile accidents, and criminal or terrorist attacks, domestic and international emergency management and relief agencies struggle to provide adequate and timely medical assistance. Similar concerns, of course, apply during times of military conflict. The traditional approach has been to attempt to stabilize the patient in the field with paramedical personnel. The patient is then placed upon a gurney or stretcher, and transported via ambulance or helicopter to a medical facility for further treatment. In support of such an approach, a variety of equipment has been developed.

For example, in U.S. Pat. No. 4,352,991 to Kaufman (Oct. 5, 1982), a Portable Life Support System is provided for use with any of a variety of patient transport vehicles. In that device, a plurality of interchangeable life support units, such as a defibrillator apparatus, an electrocardiograph monitor, a suction apparatus, an oxygen administration unit, supply drawers, and the like, may be removably mounted in a support structure that, in turn, may be removably mounted in association with a collapsible, tubular-constructed, wheeled stretcher. The support structure may be interconnected with a DC power supply and, further, with the power supply of a transporting vehicle. Such a device requires, however, that each life support unit and supply drawer be of a standard size. This degree of standardization, unfortunately, has yet to be implemented fully amongst the various medical equipment suppliers. Such a device is further disadvantageous in that the support structure is mounted above the patient, effectively impairing the delivery to the patient of a variety of medical procedures, especially those that are surgical in nature. While the support structure is removable, two or more persons typically are required to so lift and remove the structure. In such disjointed form, the various patient-connected lines must be further manipulated in order to ensure that they continue to function and do not interfere with the timely delivery of medical services to the patient.

In U.S. Pat. No. 4,584,989 to Stith (Apr. 29, 1986), a Life Support Stretcher Bed is provided primarily for use in a hospital environment. That device provides a variety of features, including a stretcher bed further having an undercarriage structure that is supported by wheels upon the ground. An hydraulically operable platform is supported upon the undercarriage structure. Provision is made for an intraaortic balloon pump unit connected to the undercarriage structure. The undercarriage also carries supply drawers, a shelf, an oxygen bottle, a weighing device, and various other such apparatus. The platform carries a defibrillator shelf, and further carries a plurality of support rods for intravenous fluids and the like. Such a device, however, is not seen to be conveniently adaptable for use in those field situations described hereinabove, especially those requiring field-delivered surgical procedures.

In U.S. Pat. No. 4,953,886 to Grant (Sep. 4, 1990), a Mobile Stretcher Support is provided. This device, essentially, is a wheel supported hand truck, specially configured for receiving a stretcher, body board, or Stokes basket-type of litter. While such a device has decided utility in quickly evacuating and transporting patients from an accident or disaster scene, the device does not provide for those self-contained medical devices, equipment, and other supplies described in the art as being desirable under such circumstances.

While use of such devices undoubtedly has been effective for many patients, the general approach discussed hereinabove may be disadvantageous in a variety of circumstances. For example, sometimes the patient cannot be field-stabilized without immediate surgical intervention. Furthermore, during times of disaster, medical facilities, especially those with surgical facilities and operating rooms, often are overtaxed. Even were a patient timely to arrive at a surgical facility, his treatment may be delayed by a lack of operating rooms and supporting equipment. In some such circumstances, patients may be diverted to other facilities more capable of handling the emergency; and, again, valuable time is lost.

Even when medical and surgical facilities are available to handle the patient load, the most critical factor in saving a patient's life may be the time it takes to transport him to the facility that ultimately will provide a life-saving surgical intervention. Thus, should transport vehicles not be immediately available, or should roadways or other avenues of transport be poor or unavailable, valuable time is lost.

Another approach to the provision of field-based medical care, then, is to deliver the surgeon and operating room directly to the patient. Such an approach, under appropriate circumstances, can provide more immediate medical care and benefit to those patients requiring immediate surgical intervention than otherwise can be delivered under the stabilize-and-transport approach.

Unfortunately, however, no provision has been made in the prior art for a device specifically configured, and being further configurable, for field-based surgical procedures. The demands of such an approach require that a device be fully self-contained with equipment, supplies, electrical connections, surgical lights, and the like; that the device be stackable in order that multiple devices conveniently may be transported to the scene; that the device be susceptible of drop-position-and-operate approach; that the device accommodate a conventional stretcher or body board; that the position of each corner of the stretcher or body board independently be adjustable to accommodate various surgical procedures; that the device be rapidly configurable and re-configurable for a variety of disparate surgical procedures, whether on an individual patient or from patient-to-patient; that the device be susceptible of either accepting multiple patients or moving with an individual patient during transport; and, that the device be susceptible of transport in any of a variety of mass transport vehicles, such as an aircraft, bus, ship, or the like.

Were such a device available, it would have additional utility, advantage, and use in the outfitting of an overload area within a traditional emergency medical facility for conducting medical and surgical procedures that otherwise could not be conducted due to facility-dependent concerns; to wit, short term, but critical, shortages of surgical tables or operating rooms. Additionally, such a device could be fully equipped and then stored in an out of the way location on a plane, ship, or other such vehicle, quickly to be available for emergency surgical and medical intervention.

Thus, what is needed and apparently not heretofore available is a mobile medical and surgical table having the above-described features, utility, advantages, and uses, that can be fully outfitted for surgery and moved into a field position for immediate emergency medical and surgical intervention.

It is in the recognition of those cited defects observed within the prior art devices, combined with the recognition of those needs recited hereinabove, which have formed the objects of and the basis for the present invention. It is, therefore, to the provision of such a mobile medical emergency and surgical table that the present invention is primarily directed.

Accordingly, an object of the present invention is the provision of a mobile medical emergency and surgical table that is configured, and is further configurable, for field-based surgical procedures.

Another object of the present invention is the provision of a mobile medical emergency and surgical table that is fully self-contained with equipment, supplies, electrical connections, surgical lights, and the like.

Still another object of the present invention is the provision of a mobile medical emergency and surgical table that is stackable in order that multiple devices conveniently may be transported to the scene of an emergency.

Yet another object of the present invention is the provision of a mobile medical emergency and surgical table that is susceptible of drop-position-and-operate approach.

Yet still another object of the present invention is the provision of a mobile medical emergency and surgical table that will accommodate a conventional stretcher or body board.

A further object of the present invention is the provision of a mobile medical emergency and surgical table that will allow the position of each corner of a stretcher or body board independently be adjustable to accommodate various surgical procedures.

Still a further object of the present invention is the provision of a mobile medical emergency and surgical table that is rapidly configurable and re-configurable for a variety of disparate surgical procedures, whether on an individual patient or from patient-to-patient.

Yet a further object of the present invention is the provision of a mobile medical emergency and surgical table that is susceptible of either accepting multiple patients or moving with an individual patient during transport.

Yet still a further object of the present invention is the provision of a mobile medical emergency and surgical table that is susceptible of transport in any of a variety of mass transport vehicle, such as an aircraft, bus, ship, or the like.

Another and further object of the present invention is the provision of a mobile medical emergency and surgical table that can be used in the outfitting of an overload area within a traditional emergency medical facility for conducting medical and surgical procedures that otherwise could not be conducted due to facility-dependent concerns.

Still another and further object of the present invention is the provision of a mobile medical emergency and surgical table that can be fully equipped and then stored in an out of the way location on a plane, ship, or other such vehicle, quickly to be available for emergency surgical and medical intervention.

SUMMARY OF THE INVENTION

In keeping with these objects, features, and advantages of the present invention, and others which will become apparent hereinafter to one ordinarily skilled in the art, the present invention resides, briefly stated, in a novel mobile medical emergency and surgical table that preferably comprises a frame assembly, a pair of undercarriage assemblies, a plurality of stretcher yoke assemblies, a plurality of storage cassettes, an electrical subsystem, and a plurality of optional mounts for the attachment of medical and surgical equipment.

In the preferred embodiment, the frame assembly is a rigid structure of interconnected tubular members, sufficiently strong to enable multiple mobile medical emergency and surgical tables to be vertically stacked without crushing. At the top of each frame is provided a stainless steel or aluminum table, having a profile suitable to confine and channel liquids into a drain pipe.

Each undercarriage assembly comprises a pair of wheels mounted in a common plane to a caster support. The undercarriage assemblies are attached to the frame at respective ends and are mechanically advantaged in order that each end of the table easily may be raised and lowered by a single person. The design of the undercarriage assembly is advantageous in that it allows the two corners of each end of the frame to be lowered simultaneously, in parallel, and without significant overturning moment.

Affixed to each corner of the frame is a stretcher yoke assembly. Each yoke assembly, once set, comprises a self-cocking and resetting mechanism. In operation, the yoke assembly allows a stretcher or body board pole to be set down into the mechanism of the assembly, the closure and locking thereof being self activating. Upon lifting of the stretcher pole from the assembly, the yoke assembly is opened and, thereby, reset in order that the yoke assembly be ready to receive the next stretcher. The vertical height of each yoke assembly may be adjusted independently in order to allow the position of each corner of a stretcher or body board to be inclined separately and, thereby, optimized to accommodate various surgical procedures. The yoke assembly hooks may be rotated out of the way when it is required that multiple tables be stacked.

Mounted within the frame, and below the upper table surface are a plurality of side-accessible and interchangeable storage cassettes. Each cassette comprises at least a uniformly-sized outer skin that may be slideably engaged within any of a variety of similarly sized openings within the table frame. Each cassette is self-captured into the frame, and the self-capturing mechanism subsequently may be released by simple, one-hand manipulation. Suitably configured, the storage cassettes may comprise a single or multiple drawer arrangement; a net; or a gas canister rack for holding oxygen, anesthesia, or other bottled gases; or combinations thereof. Appropriately configured, the cassettes may be sterilized for repeated use.

The frame may be suitably wired with an electrical subsystem comprising a connection plug, an extension cord reel, and any of a variety of common medical electrical outlets. The electrical subsystem may be powered through one or more on-board direct current battery packs. In alternate configurations, the electrical subsystem may be constructed to connect to an external generator, to conventional electrical utility service, or to the electrical system of a suitably equipped transport vehicle.

The usefulness of the mobile medical emergency and surgical table of the present invention is enhanced by the wide variety and range of optional features and mounts which may be associated with it. Accordingly, provided on the frame are a plurality of optional mounts for the attachment of medical and surgical equipment. Such optional mounts, whether singly or in combination, may comprise conventional med-rails for attaching typical Mayo-type instrument trays, intravenous fluid poles, arm boards, leg and foot stirrups, light sources, and the like. Such optional mounts further may comprise multi-axis Propaq® (Protocol Systems, Inc., Beaverton, Oreg.) mounts; ventilator assembly mounts, including drawover-type assembly mounts; and the like. A trash can or bag mount may be provided for the convenience of surgical personnel. Optional D-rings may be provided for securing the table to a bulkhead, wall, deck, or pallet, or for securing multiple tables together.

Thus, an advantage and feature of the mobile medical emergency and surgical table of the present invention is that the frame assembly is sufficiently strong to enable multiple mobile medical emergency and surgical tables to be vertically stacked without crushing.

Another advantage and feature of the mobile medical emergency and surgical table of the present invention is that the undercarriage assemblies are mechanically advantaged in order that each end of the table easily may be raised and lowered by a single person. The design of the undercarriage assembly is advantageous further in that it allows the two corners of each end of the frame to be lowered simultaneously, in parallel, and without significant overturning moment.

A further advantage and feature of the mobile medical emergency and surgical table of the present invention is that it provides a novel yoke assembly, that, once set, comprises a self-cocking and resetting mechanism. The vertical height of each yoke assembly may be adjusted independently in order to allow the position of each corner of a stretcher or body board to be inclined separately and, thereby, optimized to accommodate various surgical procedures.

Yet another advantage and feature of the mobile medical emergency and surgical table of the present invention is that it provides a plurality of uniformly sized, side-accessible, and interchangeable storage cassettes.

Still another advantage and feature of the mobile medical emergency and surgical table of the present invention is that the frame may be suitably wired with an electrical subsystem comprising a connection plug, an extension cord reel, and any of a variety of common medical electrical outlets.

Yet still another advantage and feature of the mobile medical emergency and surgical table of the present invention is that its usefulness is enhanced by the wide variety and range of optional features and mounts which may be associated with it.

Thus, the mobile medical emergency and surgical table of the present invention meets each of the objectives described and set forth hereinabove. Accordingly, these and other objectives, features, and advantages of the present invention will become more fully apparent by reference to the following detailed description of the preferred embodiment, the appended claims, and the accompanying drawings.

BRIEF DESCRIPTION OF THE DRAWINGS

The present invention will be better understood by reading the Detailed Description of the Preferred Embodiment with reference to the accompanying drawing Figures, in which like reference numerals denote similar structure and refer to like elements throughout, and in which.

DETAILED DESCRIPTION OF THE PREFERRED EMBODIMENT

Figure 1:
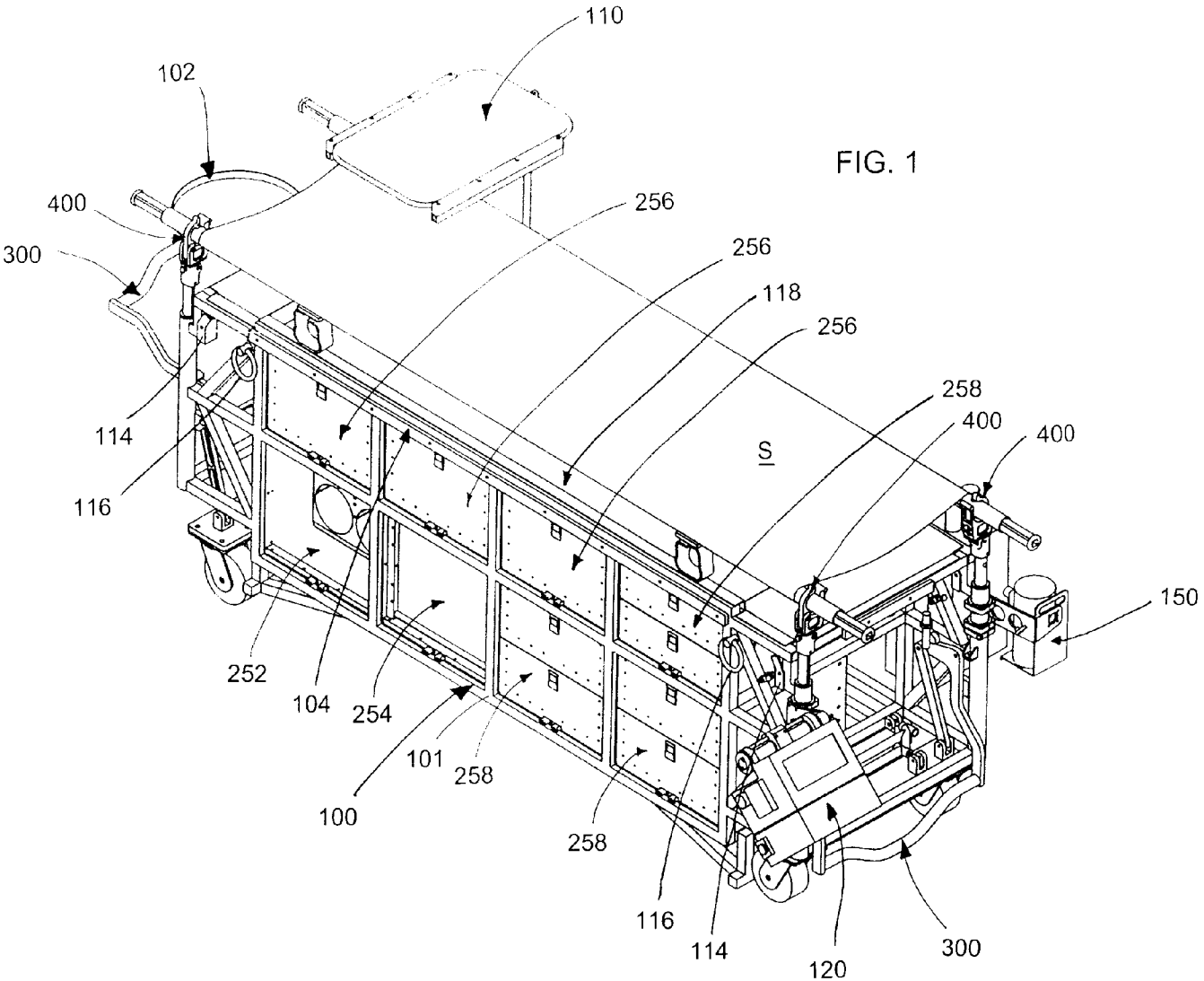
FIG. 1 is a perspective view of the front side of the preferred embodiment of the mobile medical emergency and surgical table of the present invention.
Figure 2:
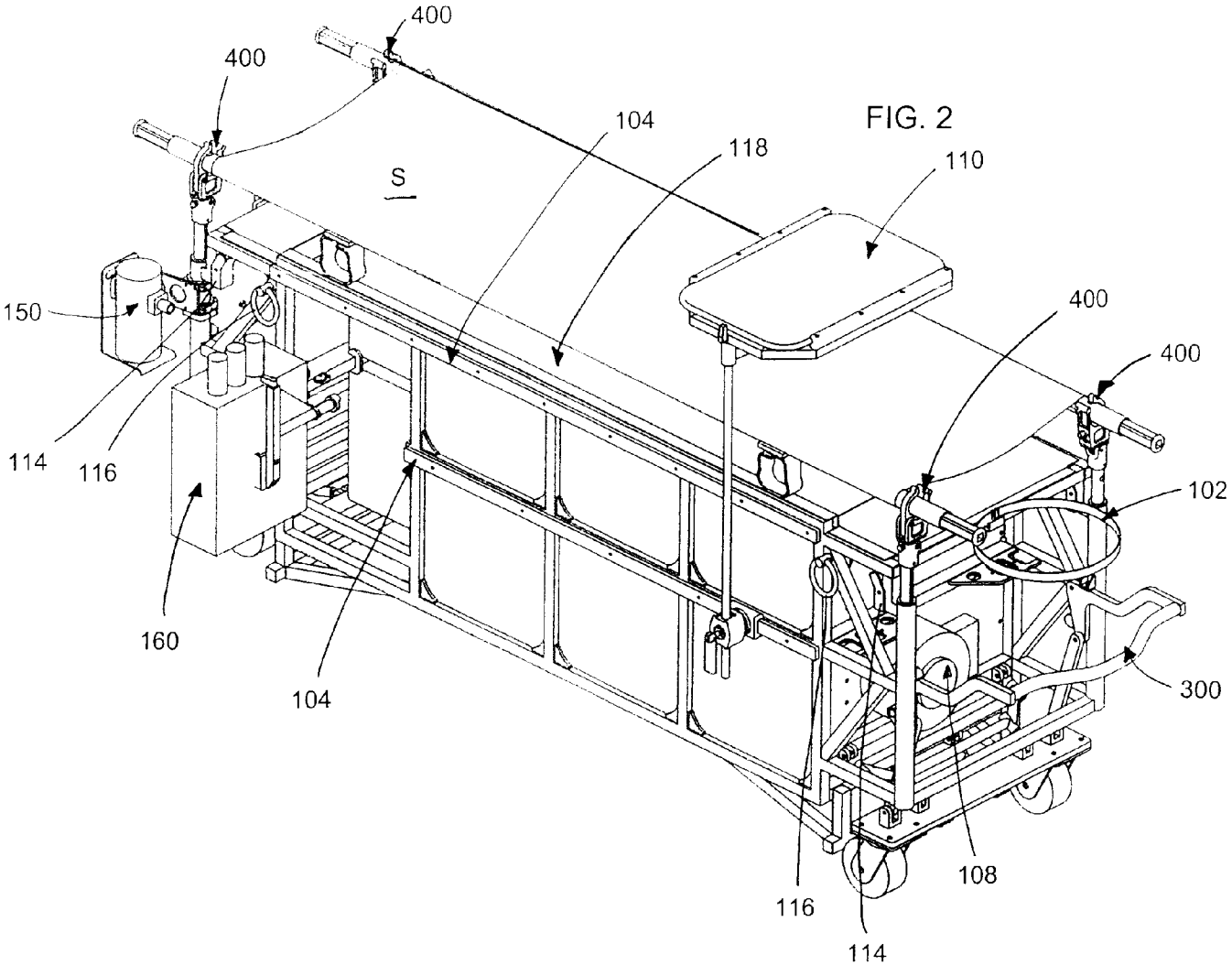
FIG. 2 is a perspective view of the rear side of the preferred embodiment of the mobile medical emergency and surgical table of the present invention.
Figure 3:
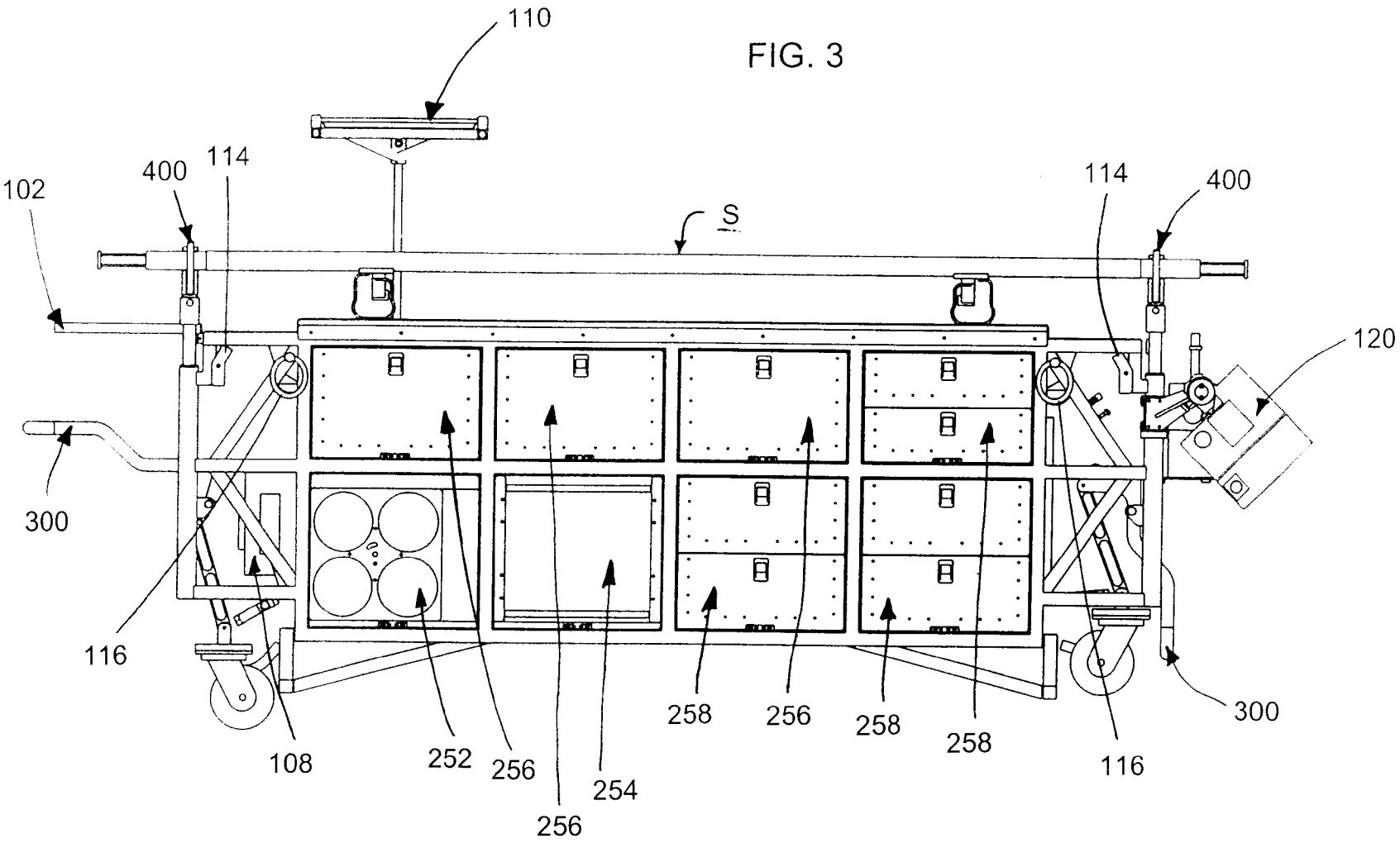
FIG. 3 is a side view of the front side of the preferred embodiment of the mobile medical emergency and surgical table of the present invention.

In describing the preferred embodiments of the present invention illustrated in the Figures, specific terminology is employed for the sake of clarity. The invention, however, is not intended to be limited to the specific terminology so selected, and it is to be understood that each specific element includes all technical equivalents which operate in a similar manner to accomplish a similar purpose.

Referring now to the drawing Figures, a preferred embodiment of the mobile medical emergency and surgical table 100 of the present invention is described in detail.

Seen in FIGS. 1 through 6 are various views of table 100. Table 100 generally comprises a frame assembly 101, a pair of undercarriage assemblies 300, a plurality of stretcher yoke assemblies 400, a plurality of storage cassettes 252, 254, 256, 258, an electrical subsystem 190, and a plurality of optional mounts 102, 104, 106, 108, 110, 120, 150, 160, for the attachment of medical and surgical equipment.

In the preferred embodiment, the frame assembly 101 is a rigid structure of preferably rectangular and circular tubular members, interconnected preferably by welding in order to be sufficiently strong to enable multiple mobile medical emergency and surgical tables to be vertically stacked without crushing. At the top of each frame 101 is provided a stainless steel or aluminum table surface 118, having a profile suitable to confine and channel byproduct liquids of a surgical procedure into a drain pipe (not shown).

Best seen with reference to FIGS. 15 through 18, each undercarriage assembly 300 comprises a pair of wheel caster assemblies 302 mounted in a common plane to a caster support 312. The undercarriage assemblies 300 are attached to the frame 101 at respective ends and are mechanically advantaged, in the order of approximately 4:1, in order that each end of the table 100 easily may be raised and lowered by a single person. In operation, lever arm 304 operated connecting bar 306 which causes caster support 312 to move up or down. The design of the undercarriage assemblies 300 is advantageous in that it allows the two corners of each end of the frame 101 to be lowered simultaneously, in parallel, and without significant overturning moment.

Affixed to each corner of the frame 101 is a stretcher yoke assembly 400. Best seen with reference to FIGS. 19 through 26, yoke 400 generally comprises hook assembly 401, ball plunger 418, pin lock plunger 420, hook assembly mount 422, upper bushing 424, strut 426, and lower bushing 428. More specifically, hook assembly 401 comprises block stop 402, spring 404, stop guide 406, sliding bolt lock 408, hook 410, washers 412, hook mount 414, and pivot plate 416. Hook 410 generally has semicircular shaped recessed portion 410A formed to and generally above engagement portion 410H. Semicircular shaped recessed portion 410A is dimensioned to receive pole P of stretcher S and to contact a portion thereof. Extending generally outward and perpendicular from the upper portion of semicircular shaped recessed portion 410A is tab 410G. Tab 410G generally serves as a finger surface to assist in the pivoting of hook 410 to the open position as more fully described below. Formed preferably at the lower portion of semicircular shaped recessed portion 410A is contact surface 410B. Contact surface 410B is preferably angled downward from semicircular shaped recessed portion 410A at approximately a forty-five degree angle therefrom such that contact surface 410B is approximately horizontal when hook 410 is in the open cocked position as more fully described below. Engagement portion 410H serves as a means to connect hook 410 to hook mount 414 and to provide a bumper surface 410E to disengage sliding bolt lock 408 from its locked position as more fully described below.

With continuing reference to FIGS. 19 through 26, each yoke assembly 400, once set, comprises a self-cocking and resetting mechanism. In operation, the yoke assembly 400 allows a stretcher S or body board pole P to be set down into the mechanism of the assembly 400, the closure and locking thereof being self activating. Upon lifting of the stretcher S pole P from the assembly 400, the yoke assembly 400 is opened and, thereby, reset in order that the yoke assembly 400 be ready to receive the next stretcher S. The vertical height of each yoke assembly 400 may be adjusted independently through use of height adjustment handles 114, best seen with reference to FIG. 1, in order to allow the position of each corner of a stretcher S or body board to be inclined separately and, thereby, optimized to accommodate various surgical procedures. Best seen with reference to FIGS. 23 through 24, the yoke hook assembly 401 may be rotated out of the way to a stowed position when it is required that multiple tables 100 be stacked.

Figure 27:
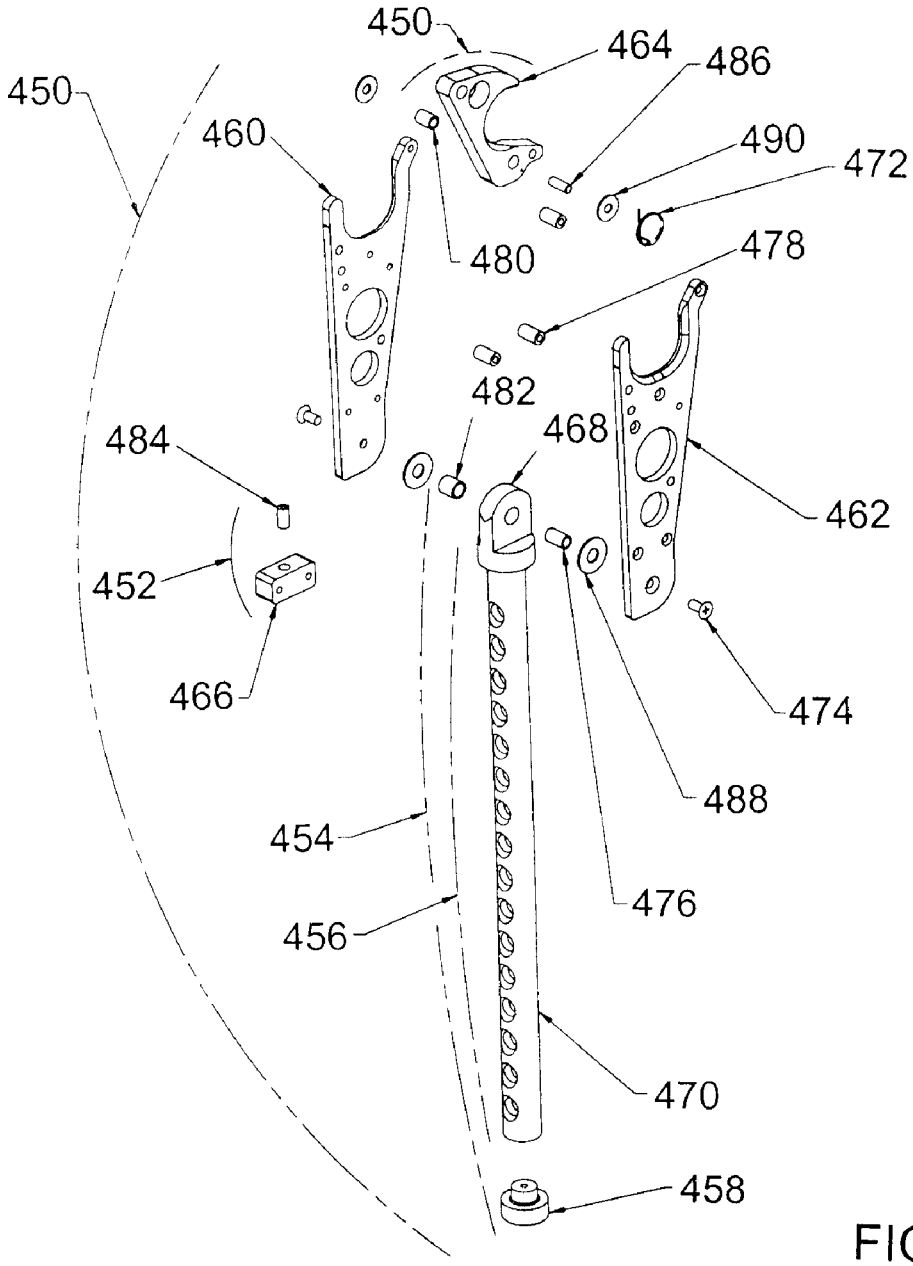

With reference to FIG. 27, shown is yoke assembly 450 according to an alternate embodiment of the mobile medical emergency and surgical table of the present invention. Yoke assembly 450 comprises plunger pivot assembly mount 452, strut assembly 454, and strut subassembly weldment 456. Strut assembly 454 carries strut 470, lower bushing 458, hook assembly mount 468, spacers 476, washers 488, bushings 480, 482, hook mounts 460, 462, and screws 474. Plunger pivot assembly mount 452 carries mounting block 466 and plunger ball 484. Yoke assembly 450 further carries hook 464, spacer 486, washers 490, torsion spring 472, bushing 480, and spacers 478. Although different in configuration, it will be apparent to those ordinarily skilled in the art that the operation of yoke assembly 450 is similar to that described with reference to yoke assembly 400 of FIGS. 19 through 26.

Although two forms of construction of the yoke assembly is of the present invention have been described in detail, it will be apparent to those ordinarily skilled in the art that other forms might be constructed having operable characteristics as described herein. Accordingly, the forms of construction presented are intended to be exemplary only and not limiting in details of construction or operation.

FIGS. 10 through 14 demonstrate a variety of interchangeable, side access storage cassettes 252, 254, 256, 258 for use with table 100. The cassettes 252, 254, 256, 258 are mounted within the frame 101, and below the upper table surface 118. Each cassette 252, 254, 256, 258 comprises at least a uniformly sized outer skin 216 that may be slideably engaged within any of a variety of similarly sized openings within the table frame 101.

Figure 14:
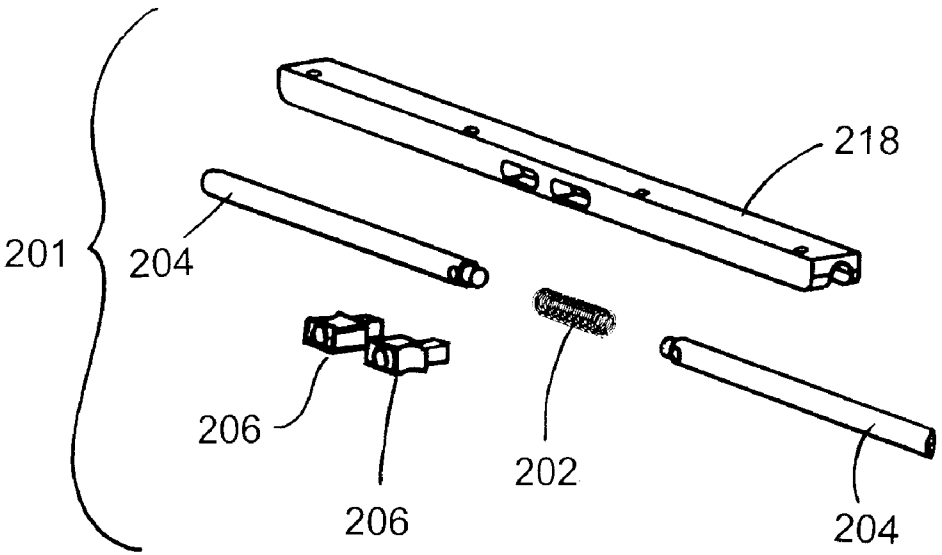
FIG. 14 is an exploded perspective view of the cassette self-capturing mechanism according to the preferred embodiment of the mobile medical emergency and surgical table of the present invention.
Figure 15:
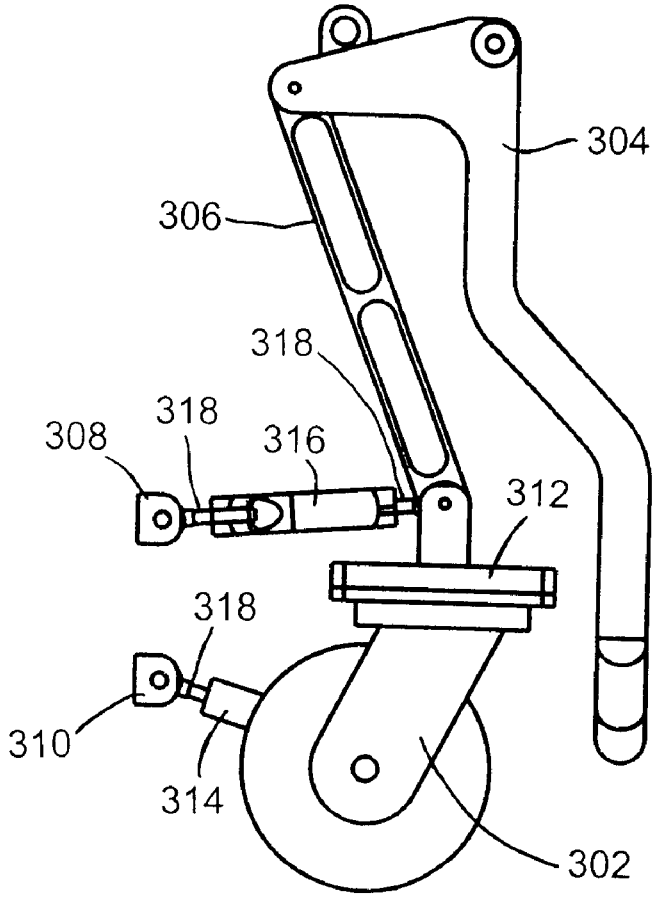
FIG. 15 is a side view of an undercarriage assembly in a lowered position according to the preferred embodiment of the mobile medical emergency and surgical table of the present invention.
Figure 16:
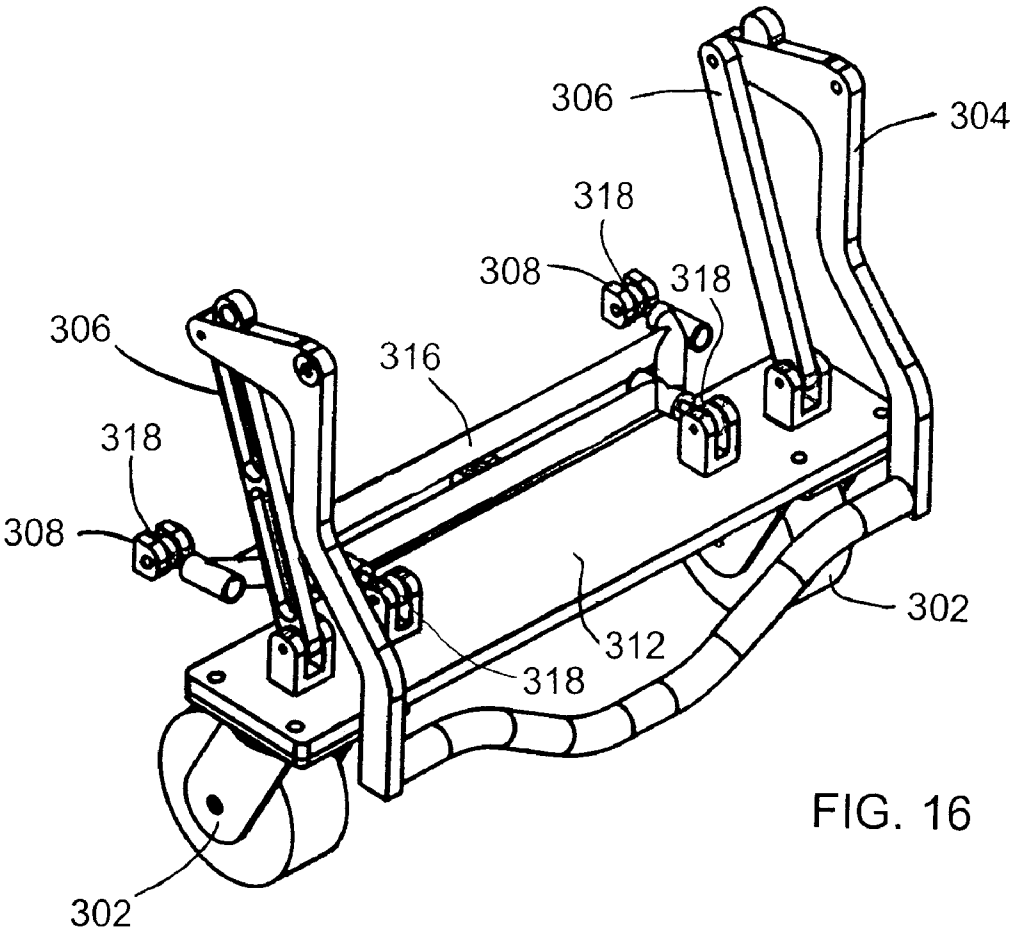
FIG. 16 is a perspective view of an undercarriage assembly in a lowered position according to the preferred embodiment of the mobile medical emergency and surgical table of the present invention.
Figure 17:
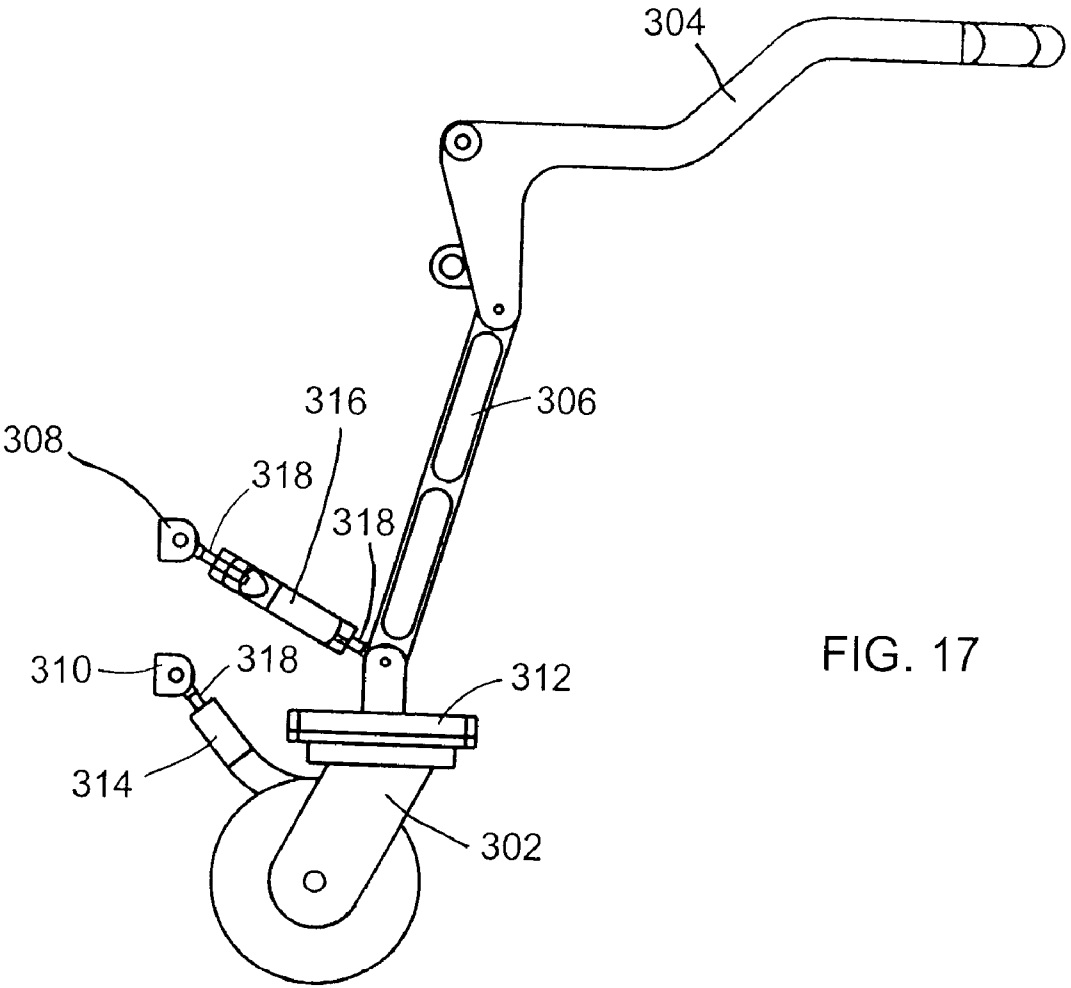
FIG. 17 is a side view of an undercarriage assembly in a raised position according to the preferred embodiment of the mobile medical emergency and surgical table of the present invention.
Figure 18:
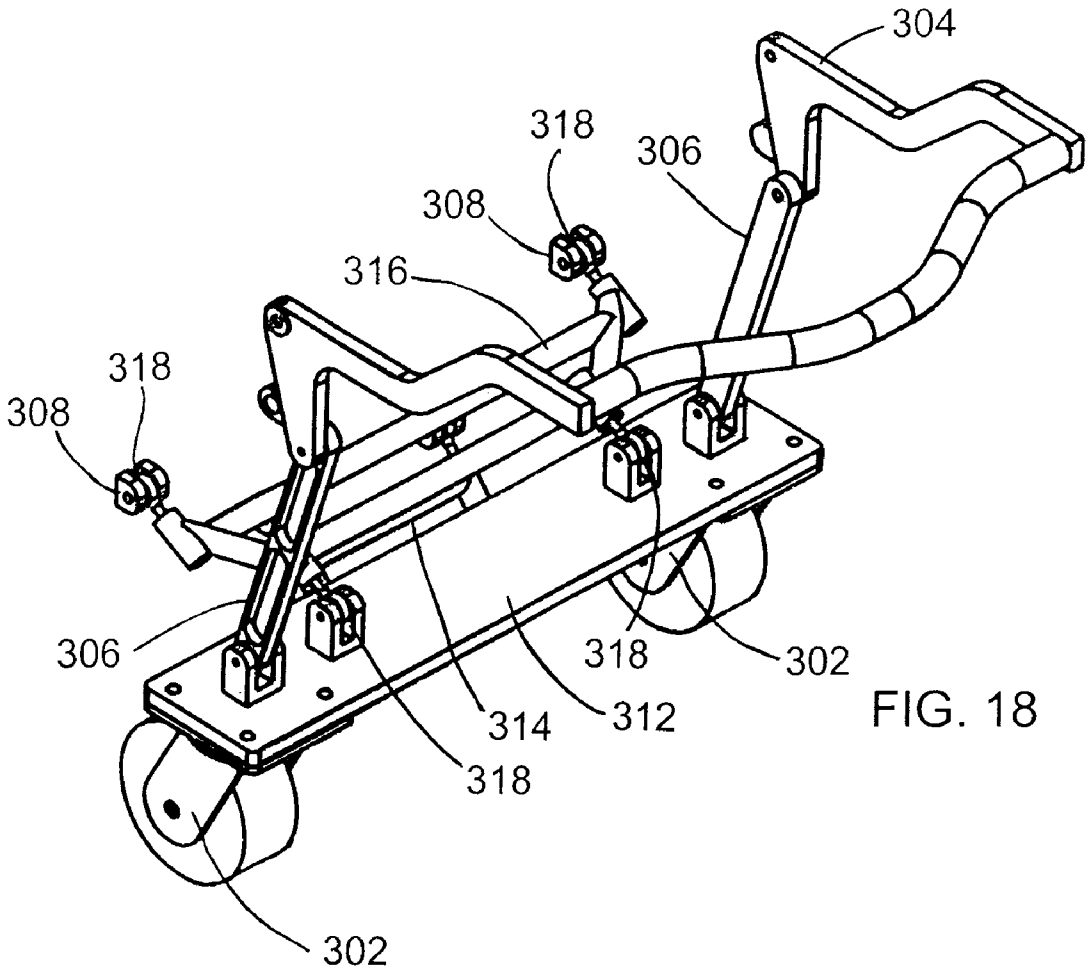
FIG. 18 is a perspective view of an undercarriage assembly in a raised position according to the preferred embodiment of the mobile medical emergency and surgical table of the present invention.
Figure 19:
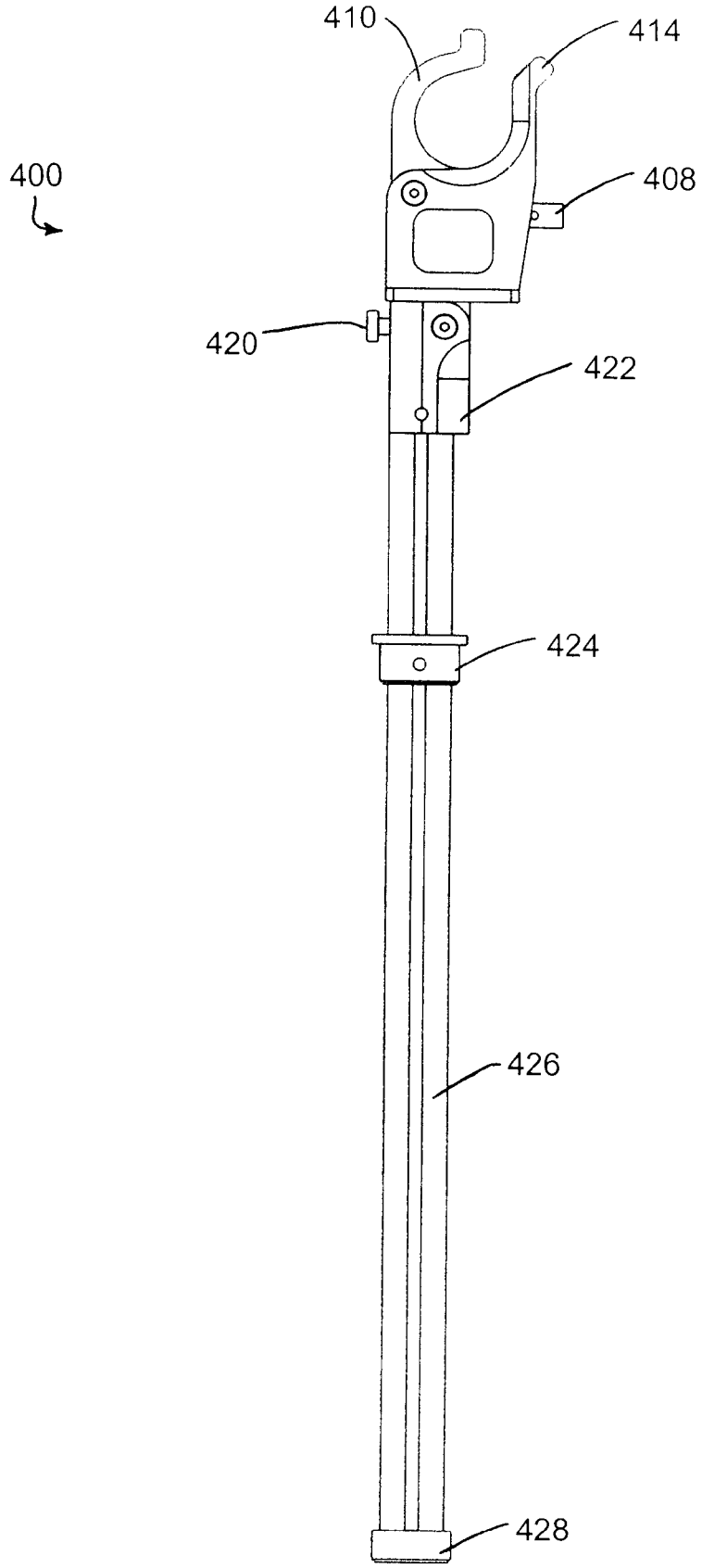
FIG. 19 is a side view of a yoke assembly in a raised position and closed according to the preferred embodiment of the mobile medical emergency and surgical table of the present invention.
Figure 20:
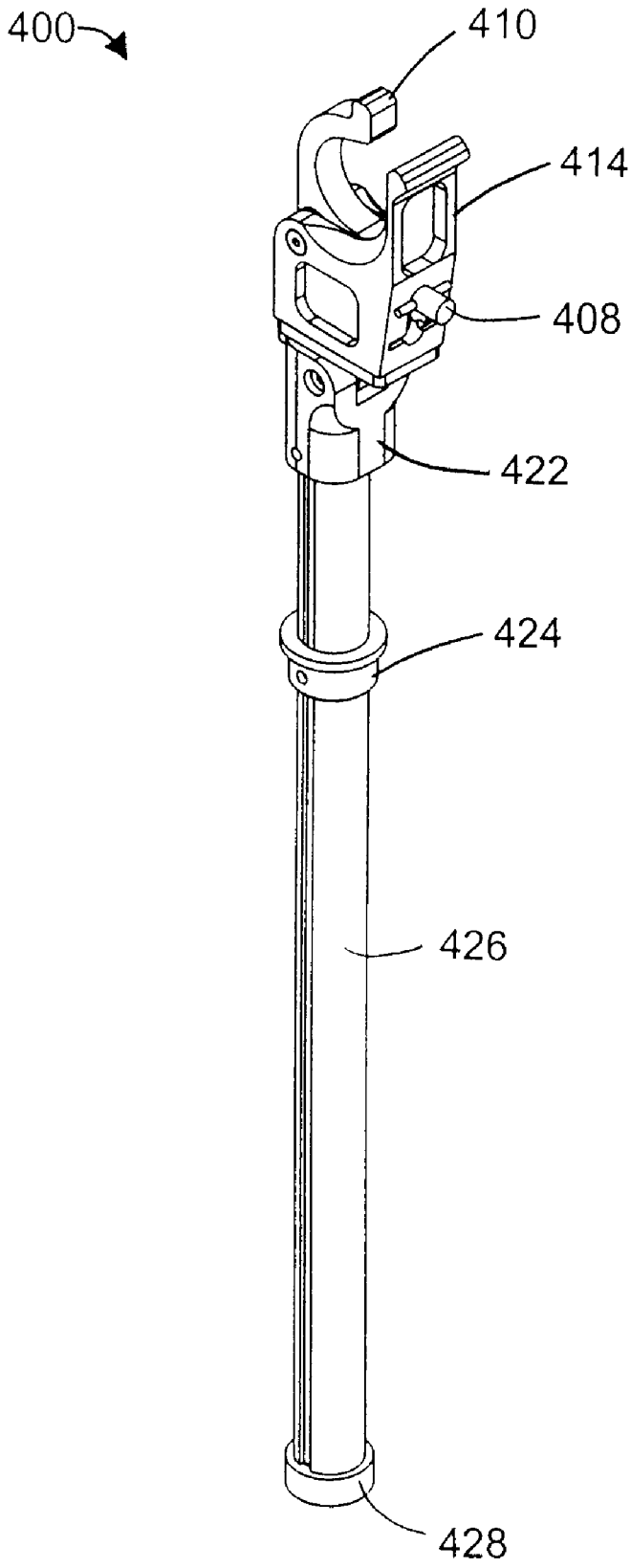
FIG. 20 is a perspective view of a yoke assembly in a raised and closed position according to the preferred embodiment of the mobile medical emergency and surgical table of the present invention.
Figure 21:
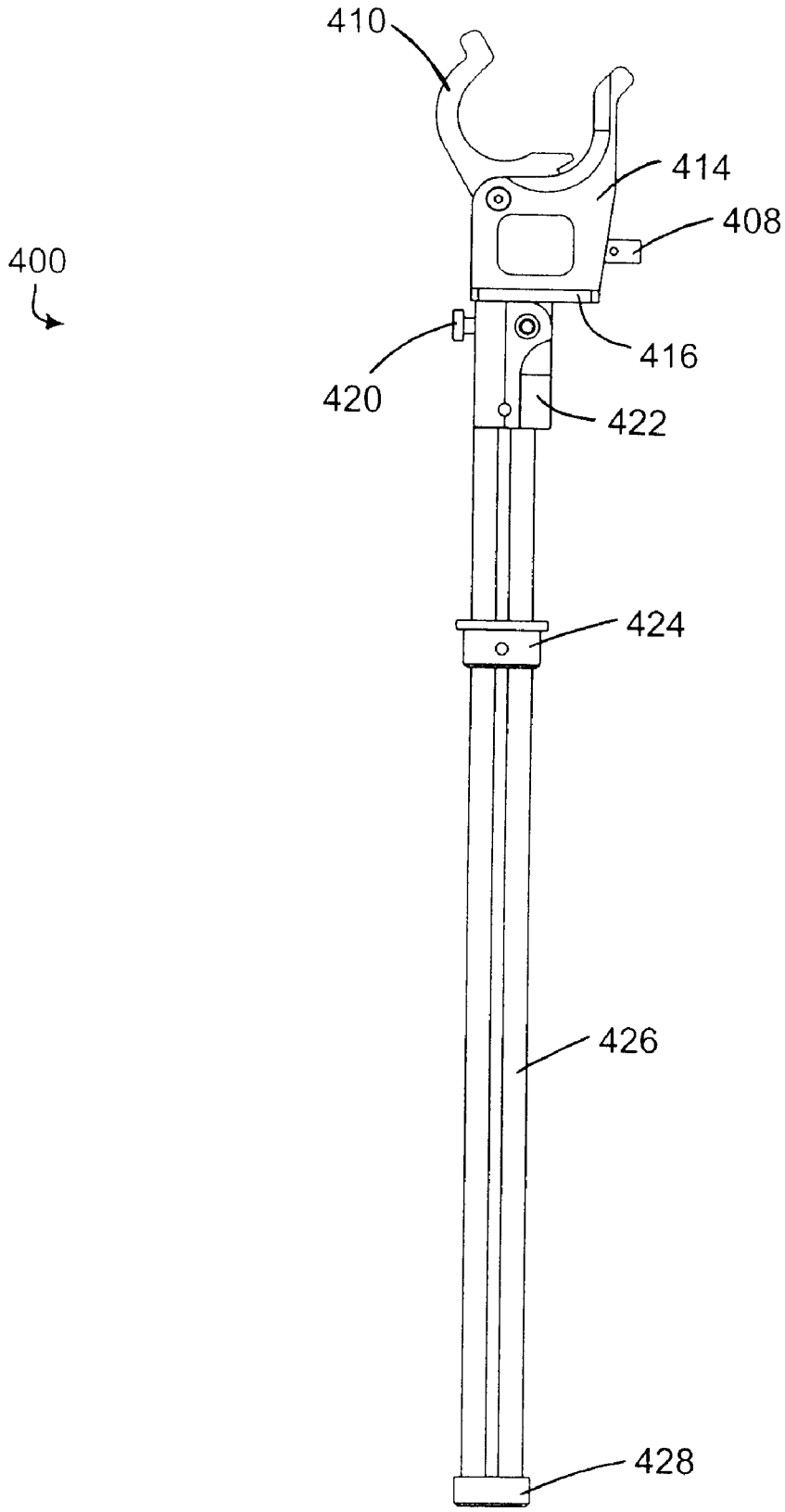
FIG. 21 is a side view of a yoke assembly in a raised and opened position according to the preferred embodiment of the mobile medical emergency and surgical table of the present invention.
Figure 22:
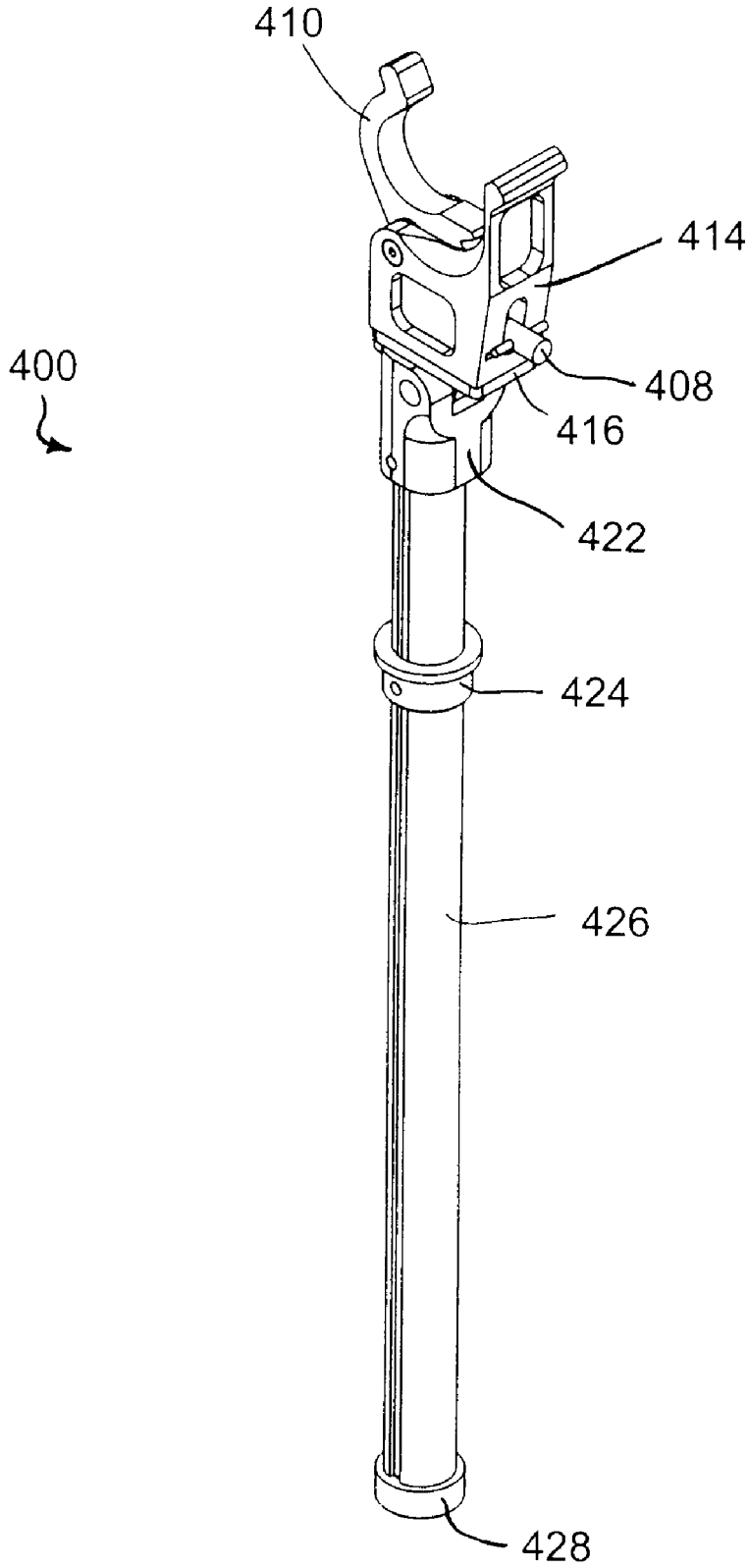
FIG. 22 is a perspective view of a yoke assembly in a raised and opened position according to the preferred embodiment of the mobile medical emergency and surgical table of the present invention.
Figure 23:
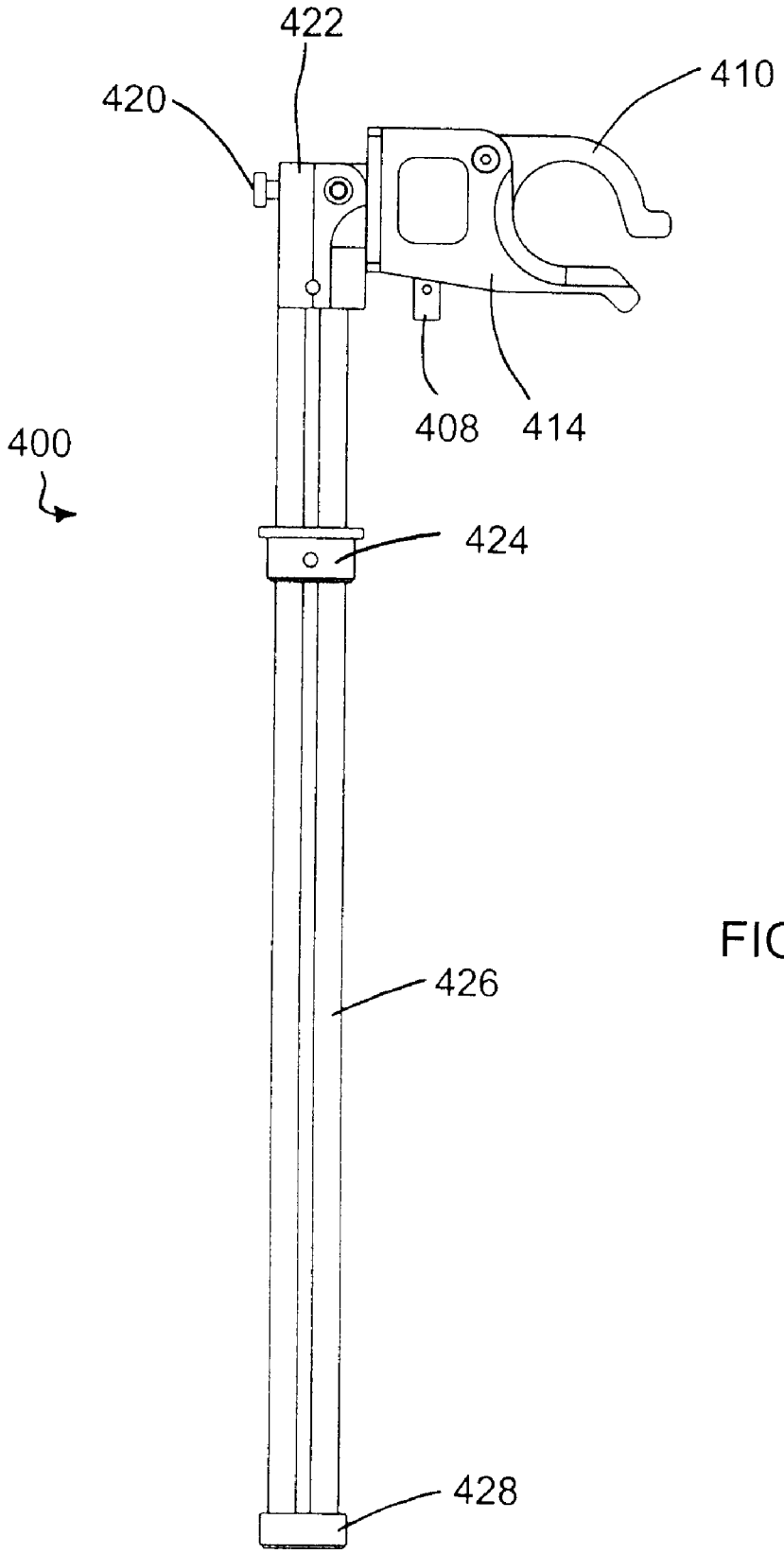
FIG. 23 is a side view of a yoke assembly in a stowed position according to the preferred embodiment of the mobile medical emergency and surgical table of the present invention.
Figure 24:
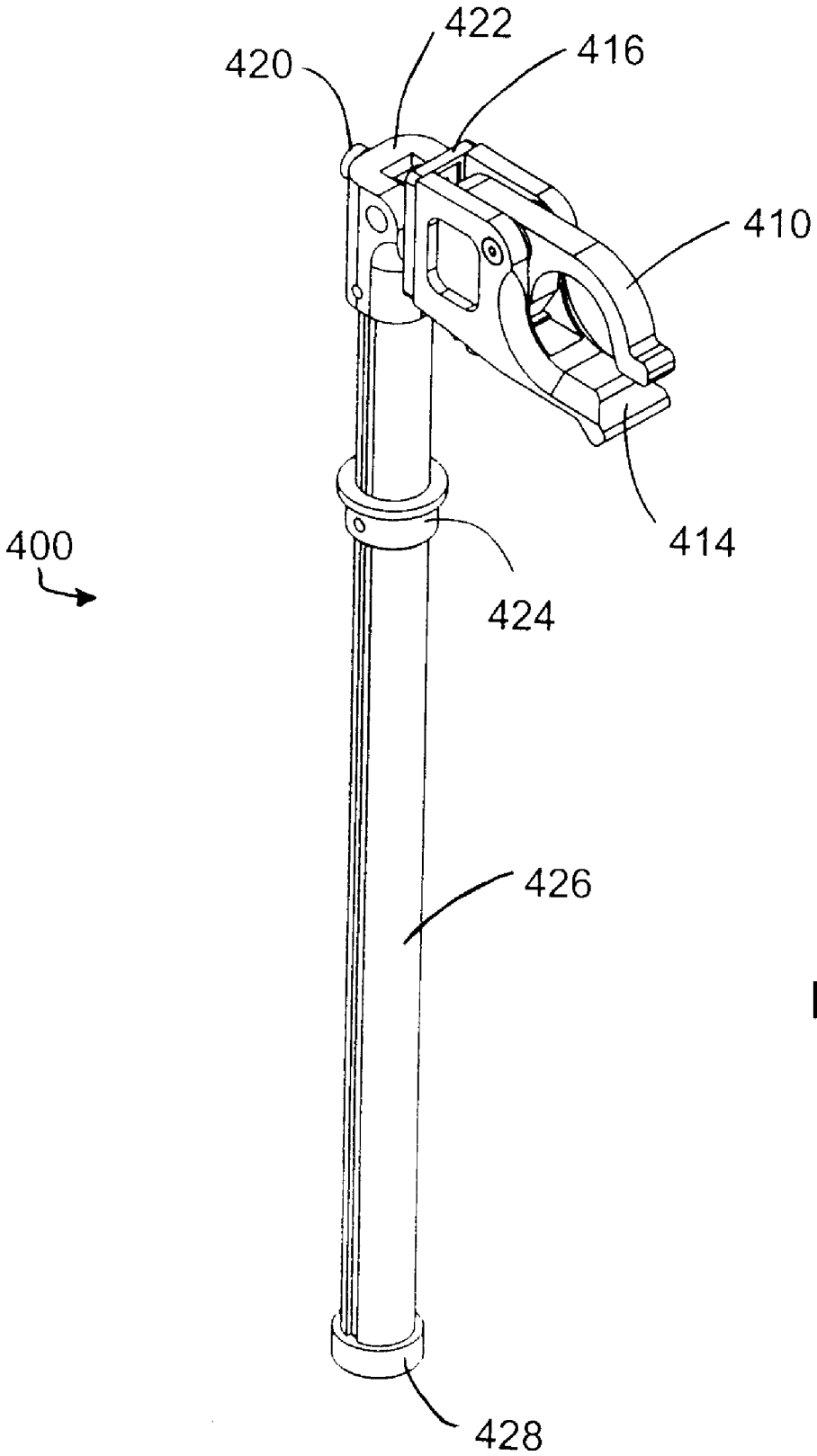
FIG. 24 is a perspective view of a yoke assembly in a stowed position according to the preferred embodiment of the mobile medical emergency and surgical table of the present invention.
Figure 25:
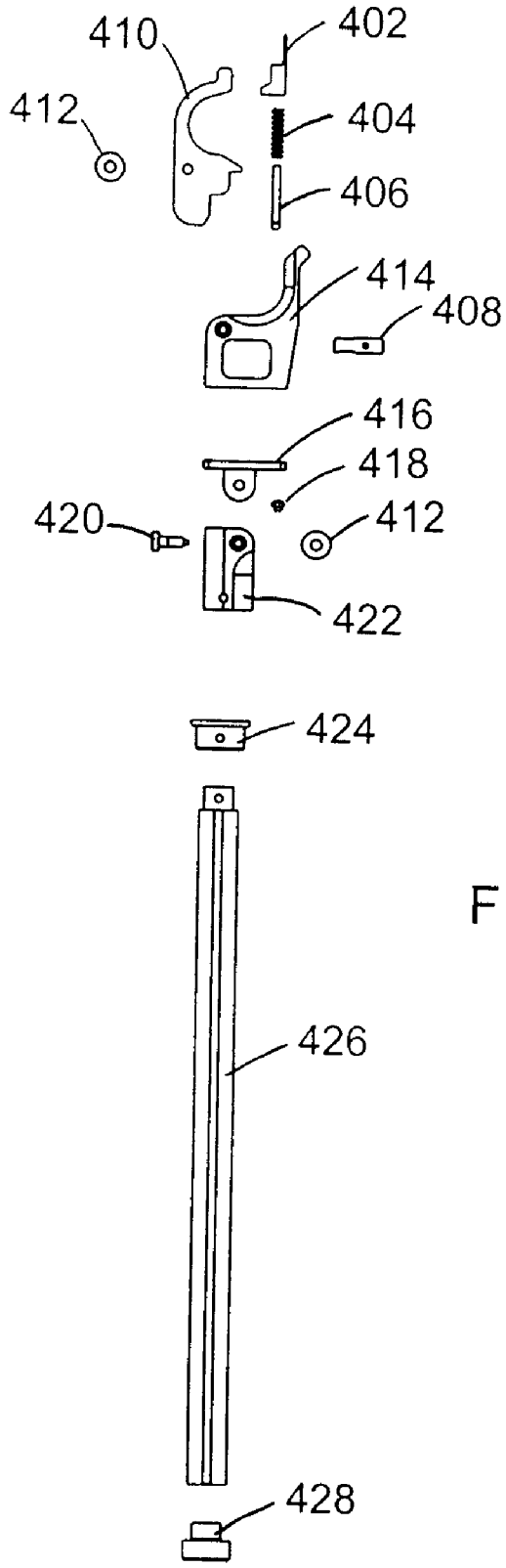
FIG. 25 is an exploded side view of a yoke assembly according to the preferred embodiment of the mobile medical emergency and surgical table of the present invention.
Figure 26:
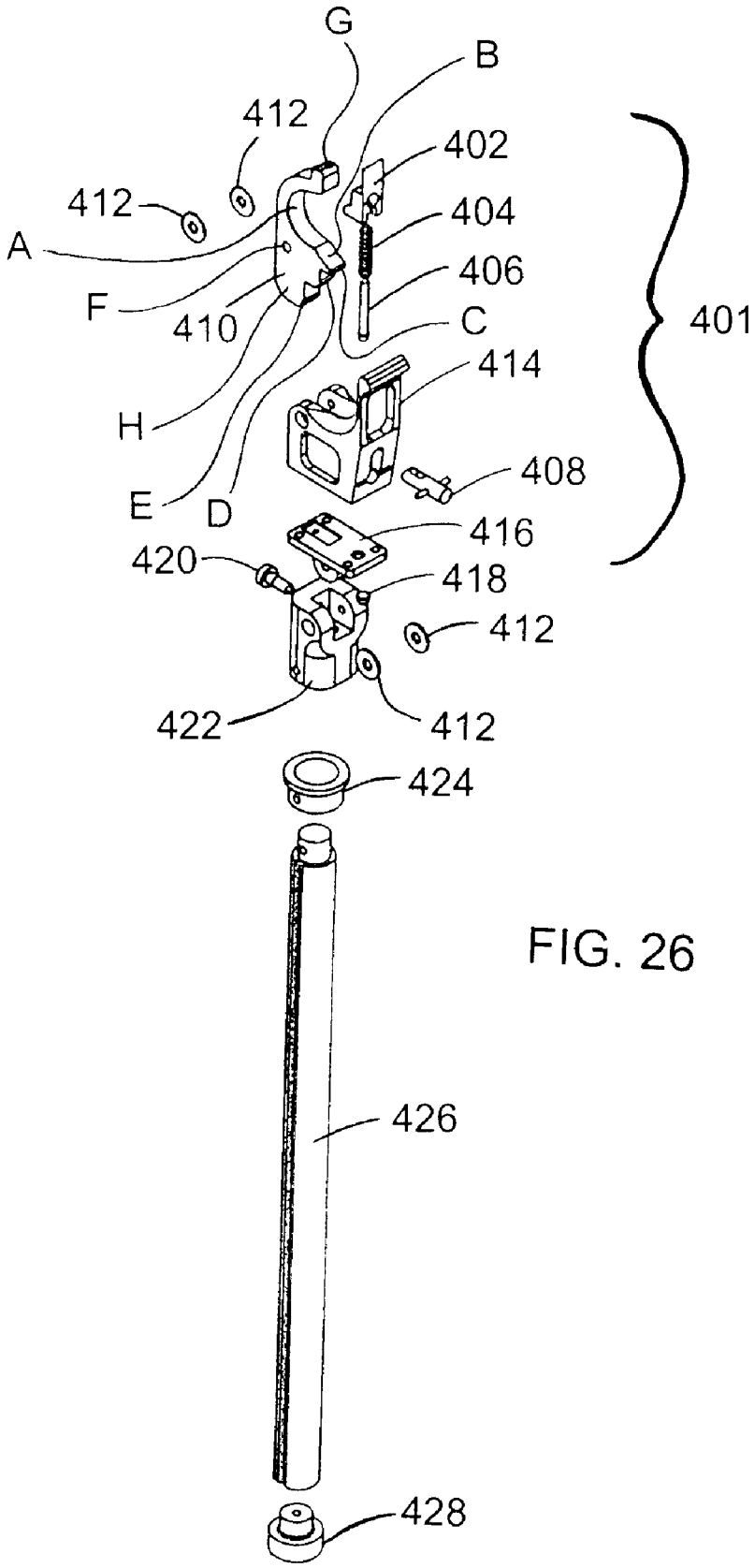
FIG. 26 is an exploded perspective view of a yoke assembly according to the preferred embodiment of the mobile medical emergency and surgical table of the present invention; and, FIG. 27 is an exploded perspective view of a yoke assembly according to an alternate embodiment of the mobile medical emergency and surgical table of the present invention.

Each cassette 252, 254, 256, 258 is self-captured into the frame 101 through use of a self-capturing latching mechanism 201, best seen with reference to FIG. 14. The self-capturing latching mechanism 201 subsequently may be released by simple, one-hand manipulation. The self-capturing latching mechanism 201 comprises catch support 218, cassette catches 204, cassette spring 202, and cassette catch knobs 206. By squeezing catch knobs 206, catches 204 are withdrawn from the frame 101, thereby allowing the cassette 252, 254, 256, 258 to be removed from the frame 101.

Figure 10:
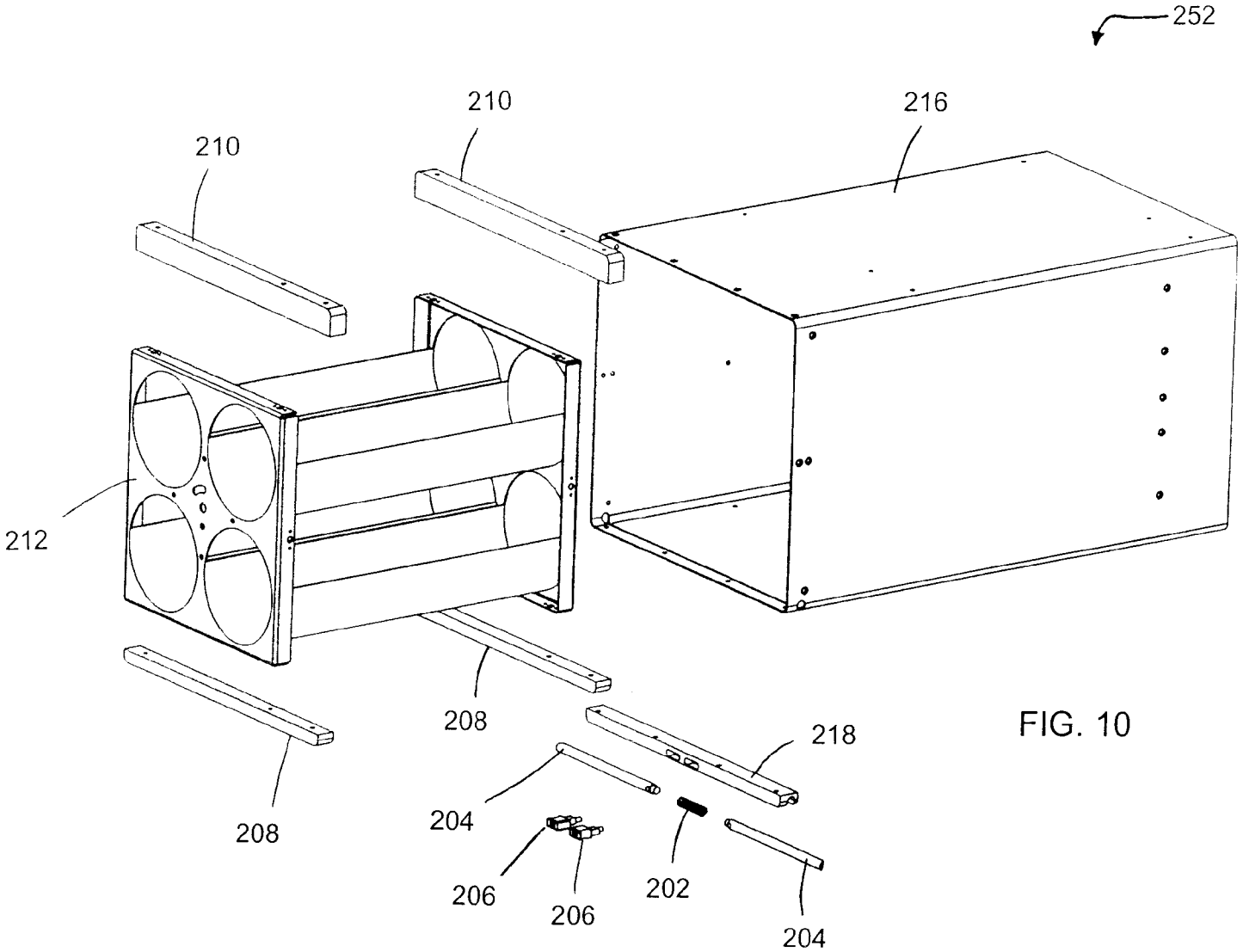
FIG. 10 is an exploded perspective view of a cassette having a gas canister rack mounted therein according to the preferred embodiment of the mobile medical emergency and surgical table of the present invention.
Figure 11:
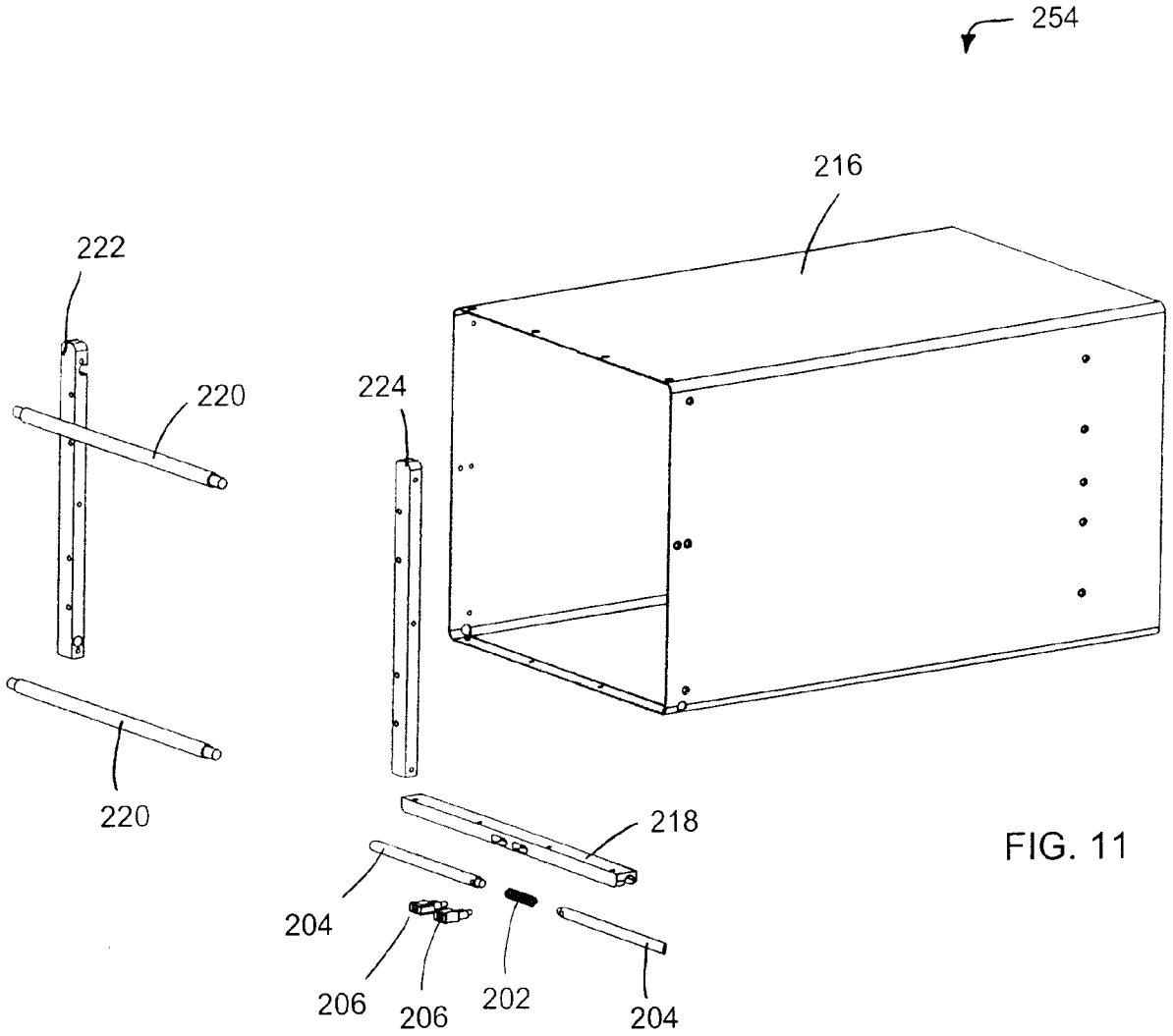
FIG. 11 is an exploded perspective view of a cassette having a net mount therein according to the preferred embodiment of the mobile medical emergency and surgical table of the present invention.
Figure 12:
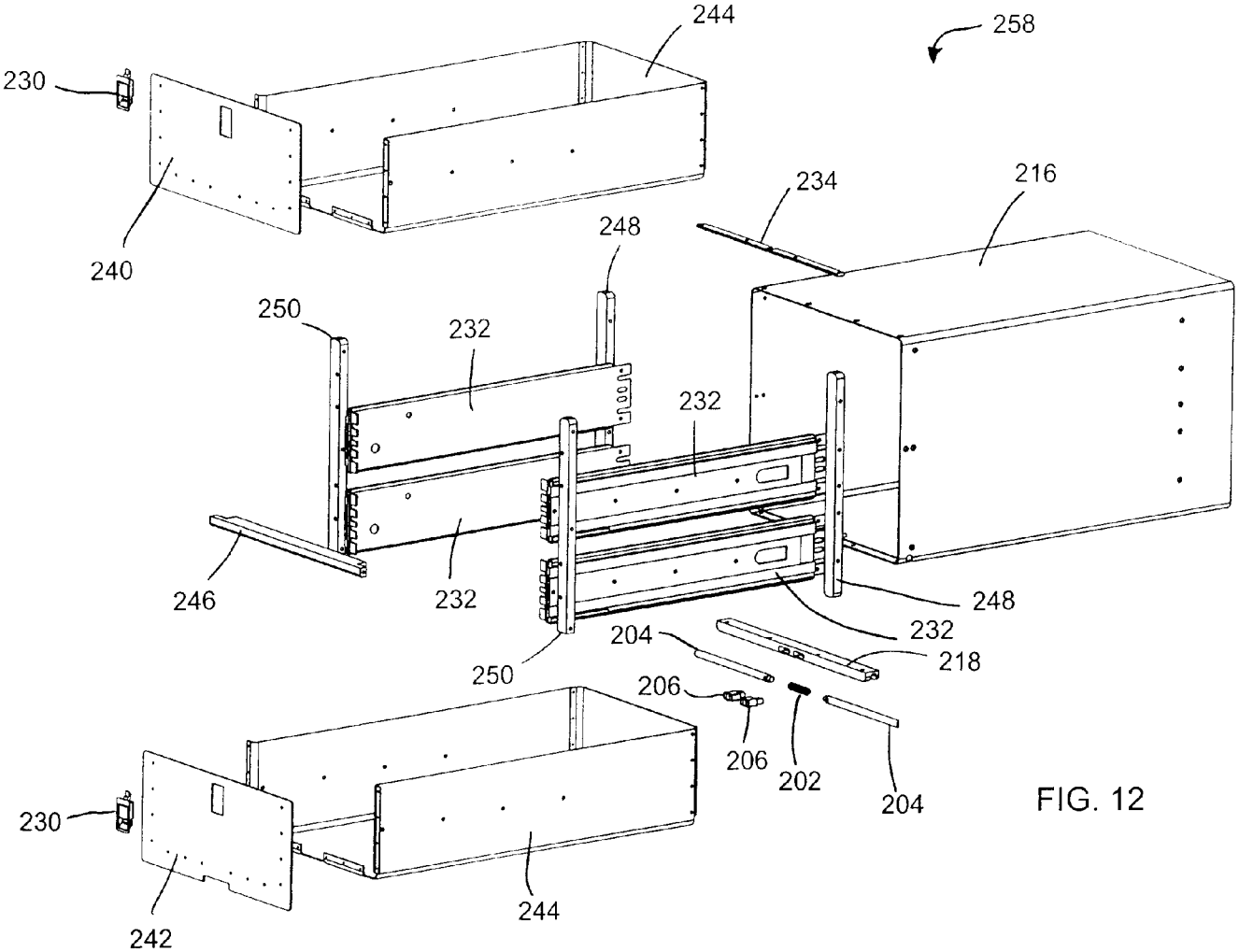
FIG. 12 is an exploded perspective view of a cassette having a two drawer mount therein according to the preferred embodiment of the mobile medical emergency and surgical table of the present invention.
Figure 13:
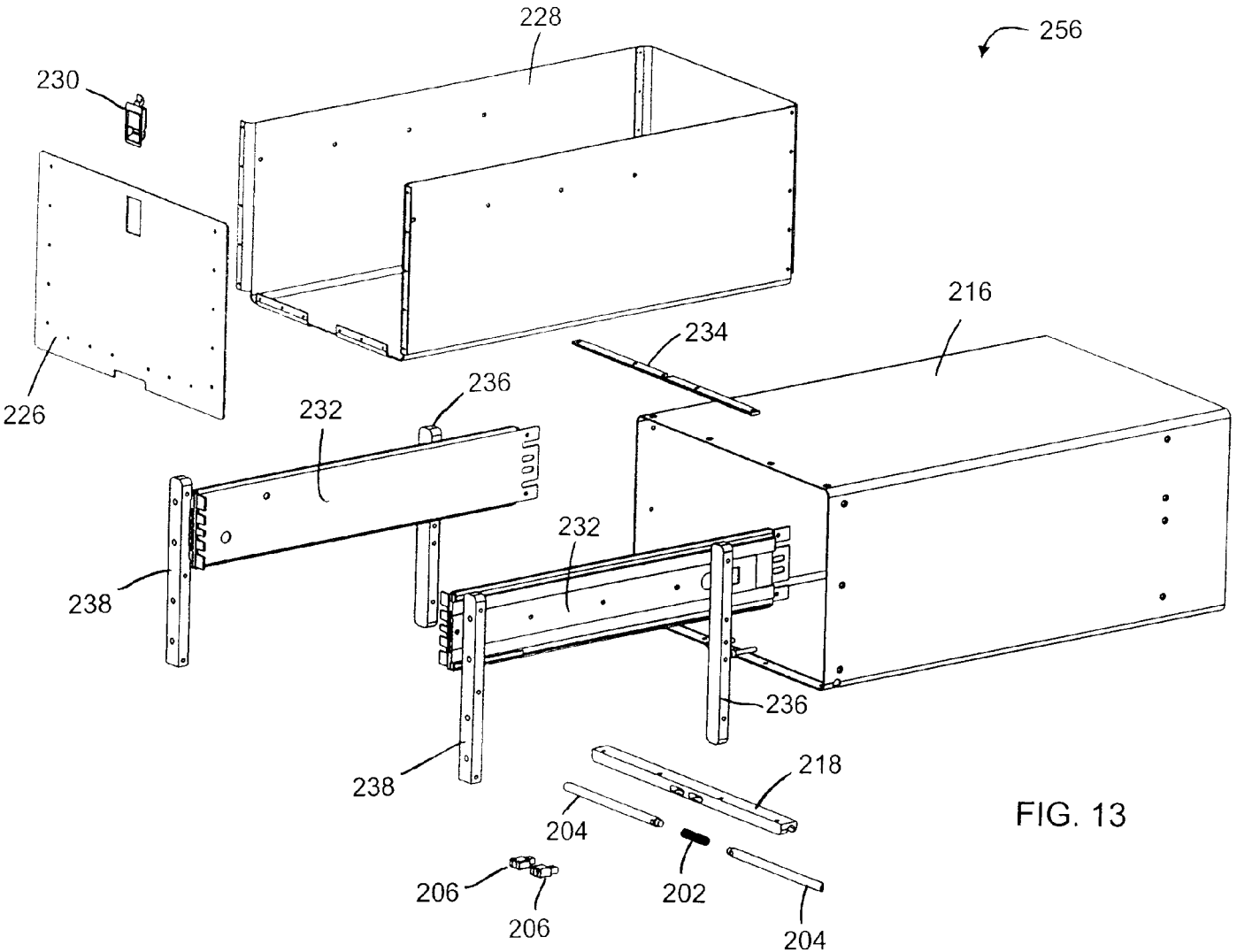
FIG. 13 is an exploded perspective view of a cassette having a one drawer mount therein according to the preferred embodiment of the mobile medical emergency and surgical table of the present invention.

Suitably configured, the storage cassettes may comprise a single drawer arrangement 256, as at FIG. 13; a multiple drawer arrangement 258, as at FIG. 12; a net arrangement 254, as at FIG. 11; or a gas canister rack 252 for holding oxygen, anesthesia, or other bottled gases, as at FIG. 10; or combinations thereof.

With reference to FIG. 10, demonstrated is a cassette 252 for storage of compressed gases, such as oxygen, anesthesia, or the like. Within outer skin 216 is mounted rack 212. Movement of rack 212 is restrained through rack mounts 208, 210. In the configuration shown, four gas bottles may be stored per cassette.

With reference FIG. 11, demonstrated is a cassette 254 for use with netting. Such a cassette may be desirable for storage of diverse and oddly shaped instruments and equipment, tubing, boxes of surgical gloves, spare electrical cords, or the like. Affixed to outer skin 216 are supports 222, 224. In use, netting (not shown) is affixed to rods 220, and rods 220 are engaged into cooperating holes and slots provided in supports 222, 224. The netting may be lowered by raising and withdrawing the uppermost rod 220 through the referenced cooperating slots.

With reference to FIG. 12, demonstrated is a two drawer cassette 258. Drawers are provided in the form of drawer pan 244, to which drawer front 240 is affixed. Slide supports 248, 250 are affixed to outer skin 216. Strikers 236, 246 are provided to constrain the withdrawal of the drawers. Slides 232 are mounted to supports 248, 250, and, in turn, to drawer pans 244. Latch paddles 230 are provided to open the respective drawers.

Similarly, and with reference to FIG. 13, demonstrated is a single drawer cassette 256. A single depth drawer pan 228 is provided, to which drawer front 226 is affixed. Slide supports 236, 238 are affixed to outer skin 216. Striker 234 is provided to constrain the movement of the drawer. Slides 232 are mounted to supports 236, 238, and, in turn, to drawer pan 228. Latch paddles 230 are provided to open the drawer.

The storage cassettes of the present invention, so provided, conveniently may accommodate the variety of surgical instruments, gas bottles, medications, spare equipment, and the like, ordinarily required to initiate and conduct a surgical procedure. Suitably configured with secure keyed locking means well-known in the art, drawer cassettes 256, 258 may be locked to in order to prevent access to narcotic drugs and other controlled substances required to be on-hand during a typical surgical procedure. Suitably configured, each cassette may be sterilized for repeated use.

The frame 101 may be suitably wired with an electrical subsystem comprising a connection plug (not shown), an extension cord reel 108, and any of a variety of common medical electrical outlets 190. The electrical subsystem may be powered through one or more on-board direct current battery packs (not shown). In alternate configurations, the electrical subsystem may be constructed to connect to an external generator, to conventional electrical utility service, or to the electrical system of a suitably equipped transport vehicle.

The usefulness of the mobile medical emergency and surgical table 100 of the present invention is enhanced by the wide variety and range of optional features and mounts which may be associated with it. Accordingly, provided on the frame 101 are a plurality of optional mounts for the attachment of medical and surgical equipment. Such optional mounts, whether singly or in combination, may comprise conventional slide rails, known as med-rails 104 for holding clamping devices for attaching typical Mayo-type instrument trays 110, intravenous fluid poles (not shown), arm boards (not shown), leg and foot stirrups (not shown), light sources, as through mount 106, and the like. A trash can or bag mount 102 may be provided for the convenience of surgical personnel. Such optional mounts further may comprise multi-axis Propaq® (Protocol Systems, Inc., Beaverton, Oreg.) mounts 120, ventilator assembly mounts 160, including drawover-type assembly mounts 150; and the like. Optional D-rings 116 may be provided for securing the table 100 to a bulkhead, wall, deck, or pallet, or for securing multiple tables together.

Figure 4:
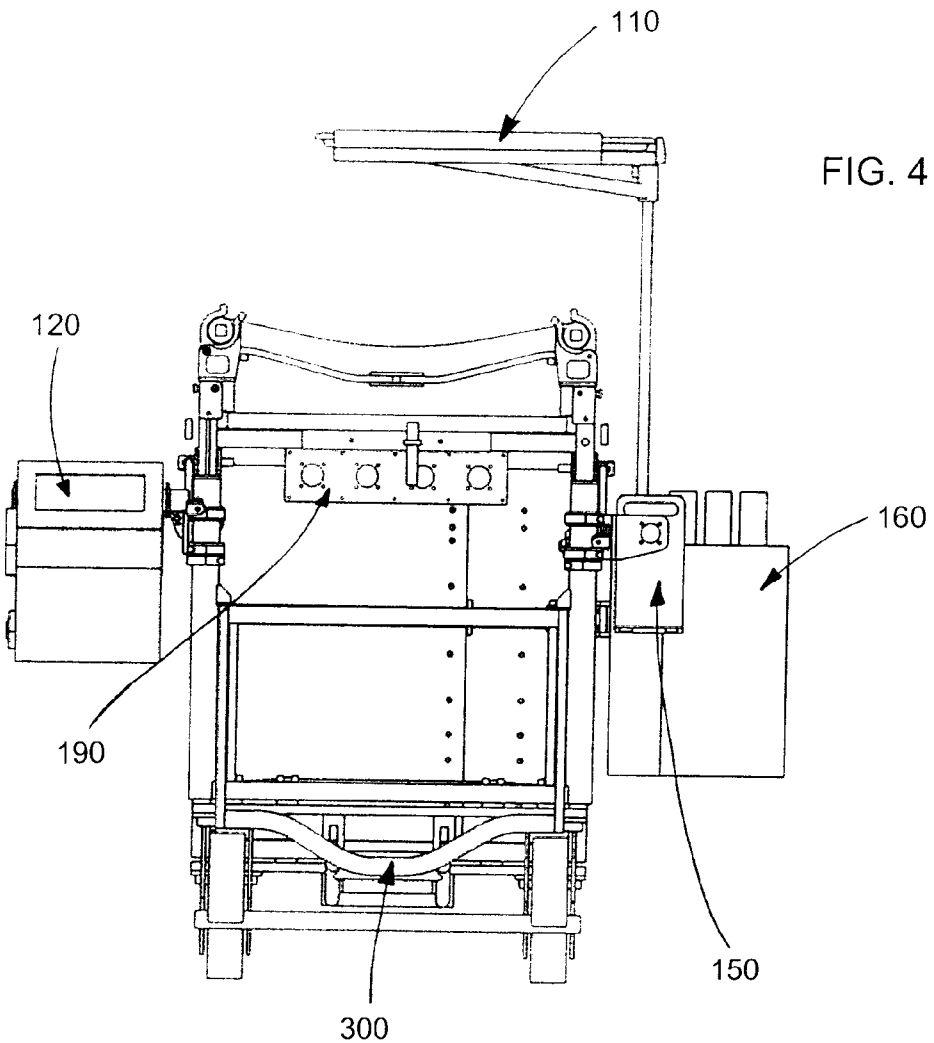
FIG. 4 is a end view of the first end of the preferred embodiment of the mobile medical emergency and surgical table of the present invention.
Figure 5:
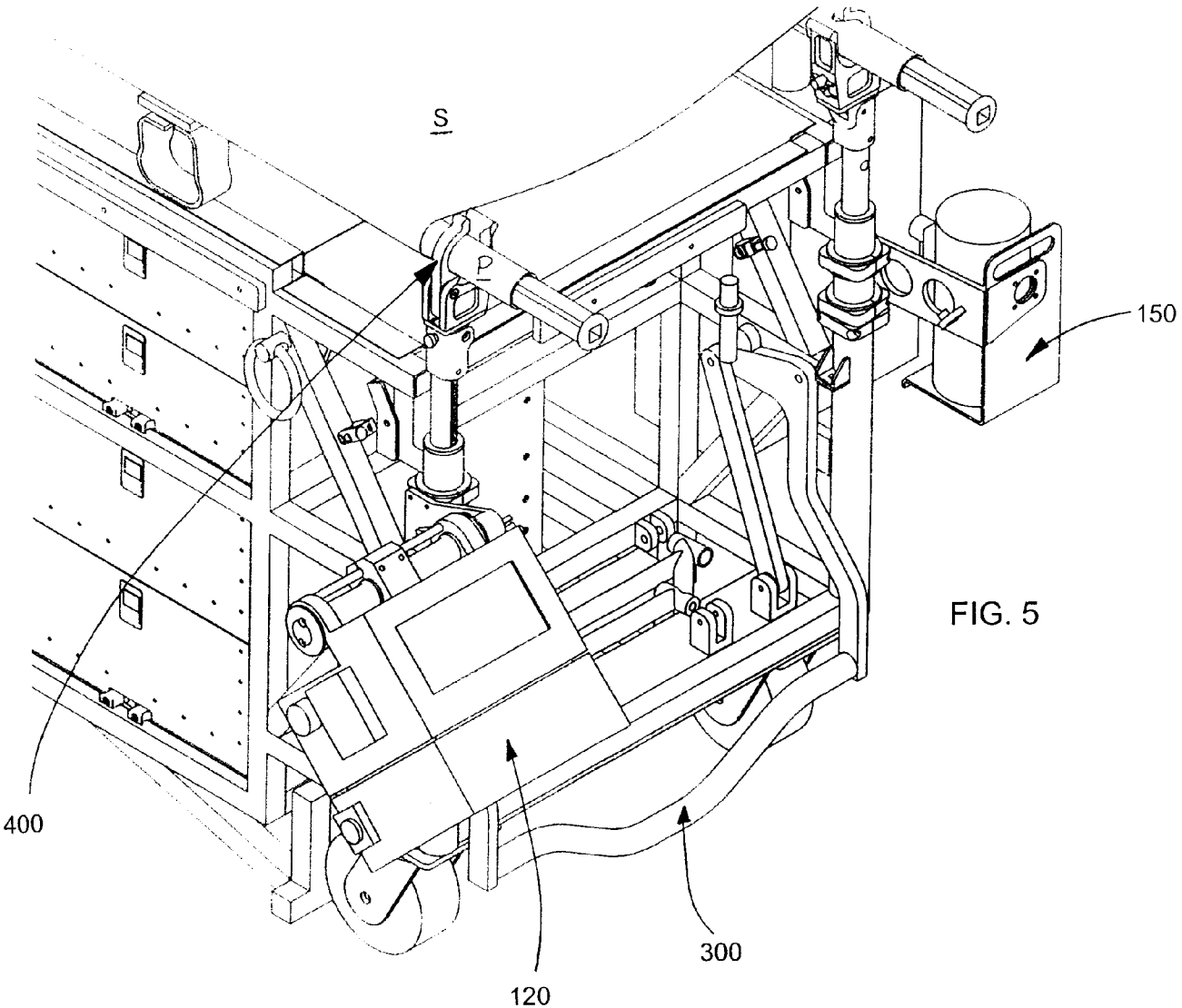
FIG. 5 is a perspective view of the first end of the preferred embodiment of the mobile medical emergency and surgical table of the present invention.
Figure 6:
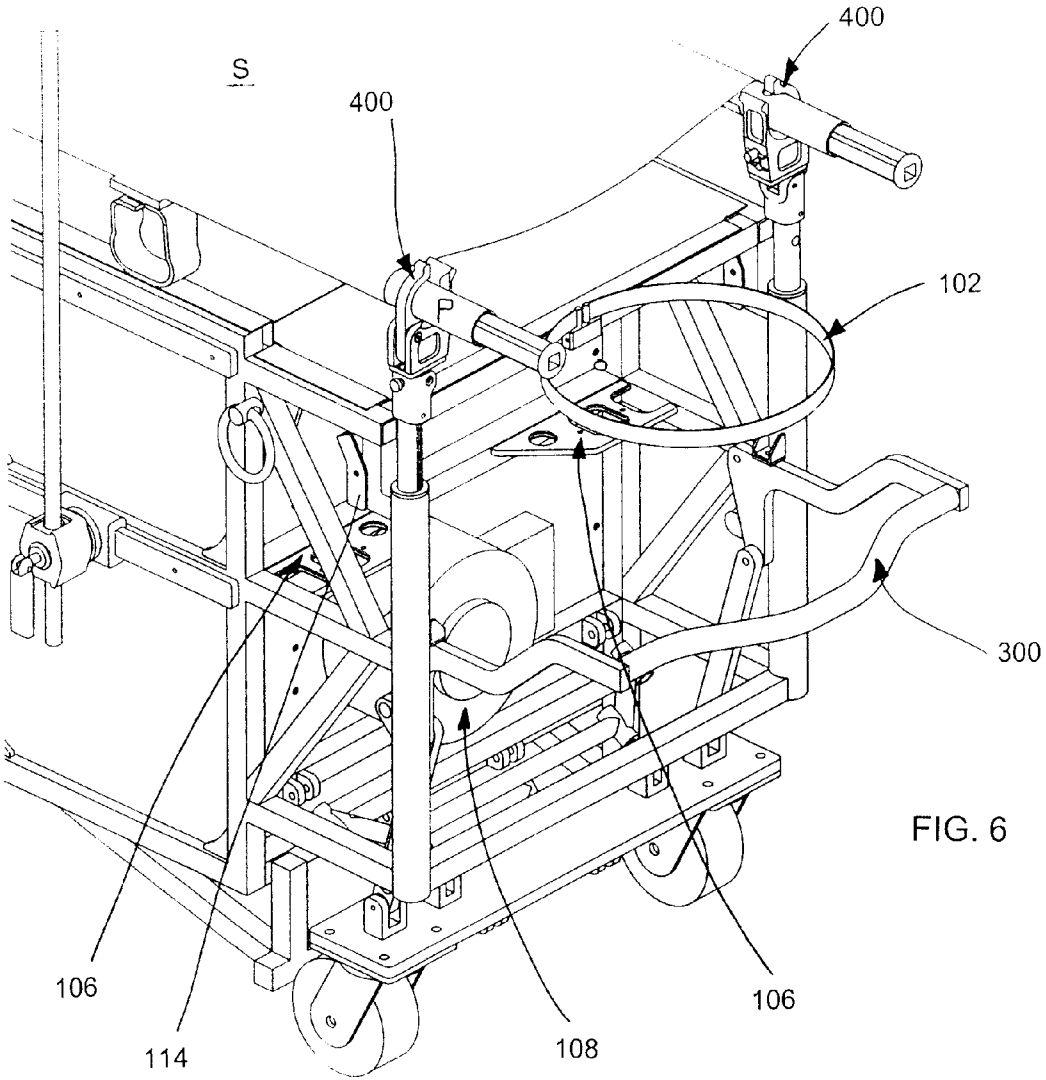
FIG. 6 is a perspective view of the second end of the preferred embodiment of the mobile medical emergency and surgical table of the present invention.
Figure 9:
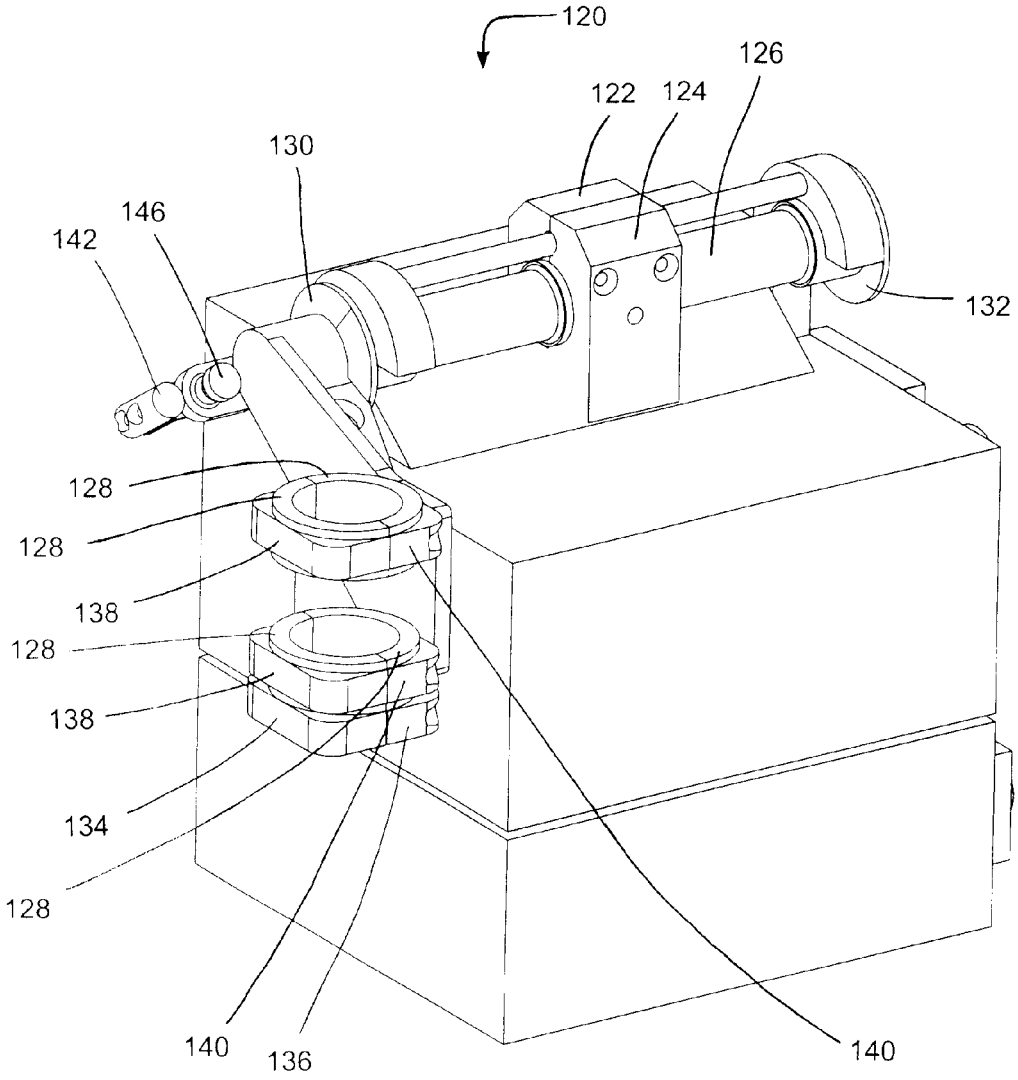
FIG. 9 is a perspective view of the Propaq® (Protocol Systems, Inc., Beaverton, Oreg.) assembly mount of the preferred embodiment of the mobile medical emergency and surgical table of the present invention.

Details of Propaq® mount 120 are best seen with reference to FIGS. 4, 5, 9. Propaq® mount 120 is comprised of back azimuth mount 122 and front azimuth mount 124. Back azimuth mount 122 and front azimuth mount 124 preferably are fabricated of a material such as Delrin®, or the like. Captured within mounts 122, 124 is Propaq® mount bar 126. Mount caps 130, 132 are provided to restrain the relative movement of the Propaq® unit. In such fashion, Propaq® mount 120 is allowed to rotate about the x-axis. Fixed clamps 134, 136 and pivot clamps 138, 140 are provided to allow the Propaq® mount 120 to be affixed to frame 101 and to rotate about the y-axis. Stop 142 and release plunger pin 146 are further provided to lock the Propaq ® into and release it from a desired position, thereby, enhancing the functionality of the Propaq® mount 120.

Figure 7:
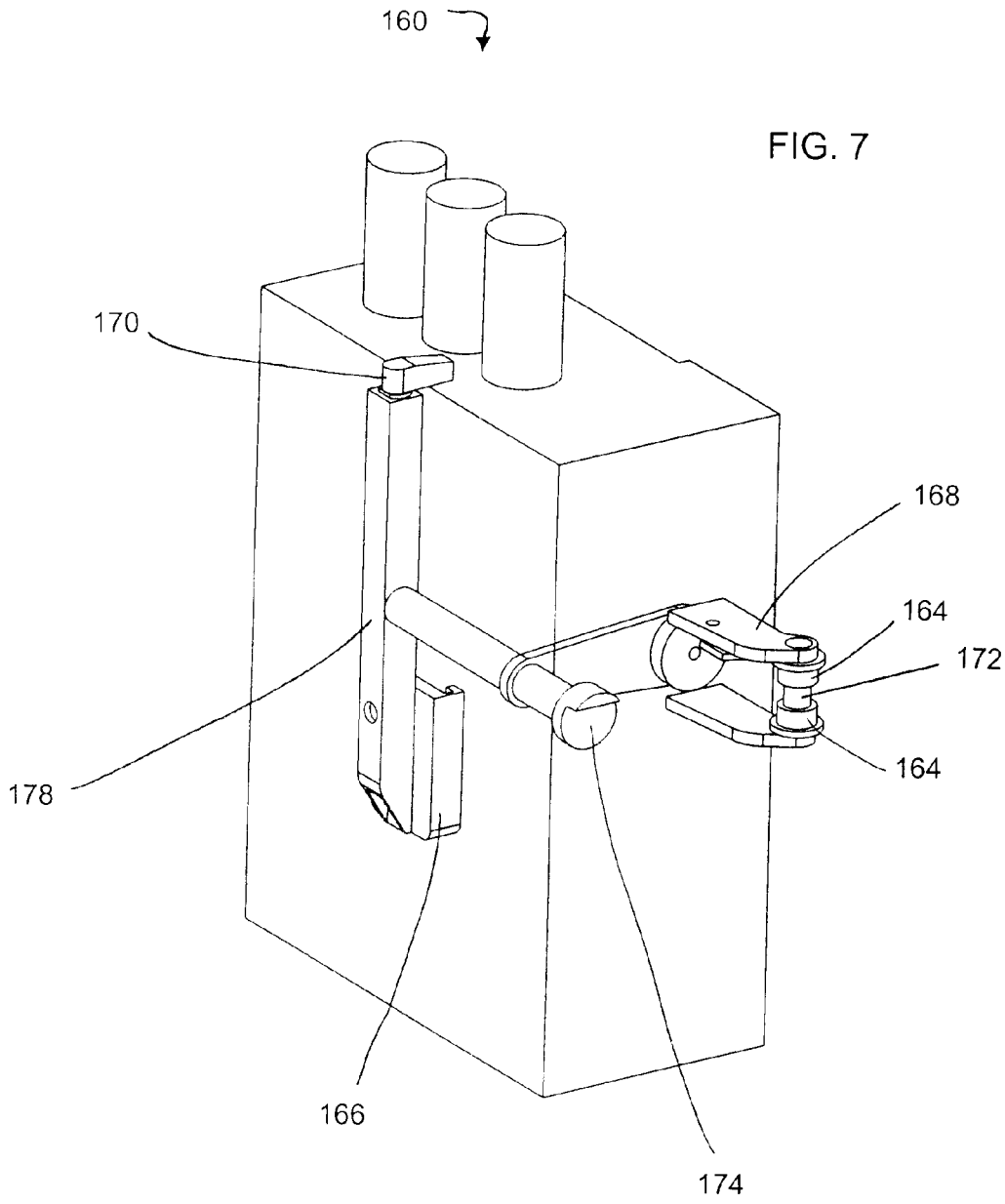
FIG. 7 is a perspective view of the ventilator assembly mount of the preferred embodiment of the mobile medical emergency and surgical table of the present invention.

Details of ventilator assembly mount 160, are best seen with reference to FIG. 7. A fork mount 168 is provided to attach ventilator assembly mount 160 to frame 101. Bushings 164 are provided in order that shaft 172 may be properly constrained and smooth in relative rotation from frame 101. A rotation stop 174 is provided to constrain the rotational movement of the ventilator assembly mount 160. A ventilator may be affixed to the ventilator assembly mount 160 through ventilator mount block 166. Ventilator mount block 166 is affixed to ventilator weldment tube 178. Weldment tube 178 is, in turn, affixed to a quarter-turn latch 170. In this form, the ventilator may be rotatably affixed to frame 101.

Although a ventilator is shown as being mounted according to FIG. 7, it will be apparent to one ordinarily skilled in the art that the ventilator, and other similar components, may be stored in a cassette drawer, and, subsequently, withdrawn for mounting upon med-rail 104. Such an arrangement beneficially may provide, in certain applications, for symmetry in cassette size and layout, and for alternative overall configuration of the mobile medical emergency and surgical table of the present invention.

Figure 8:
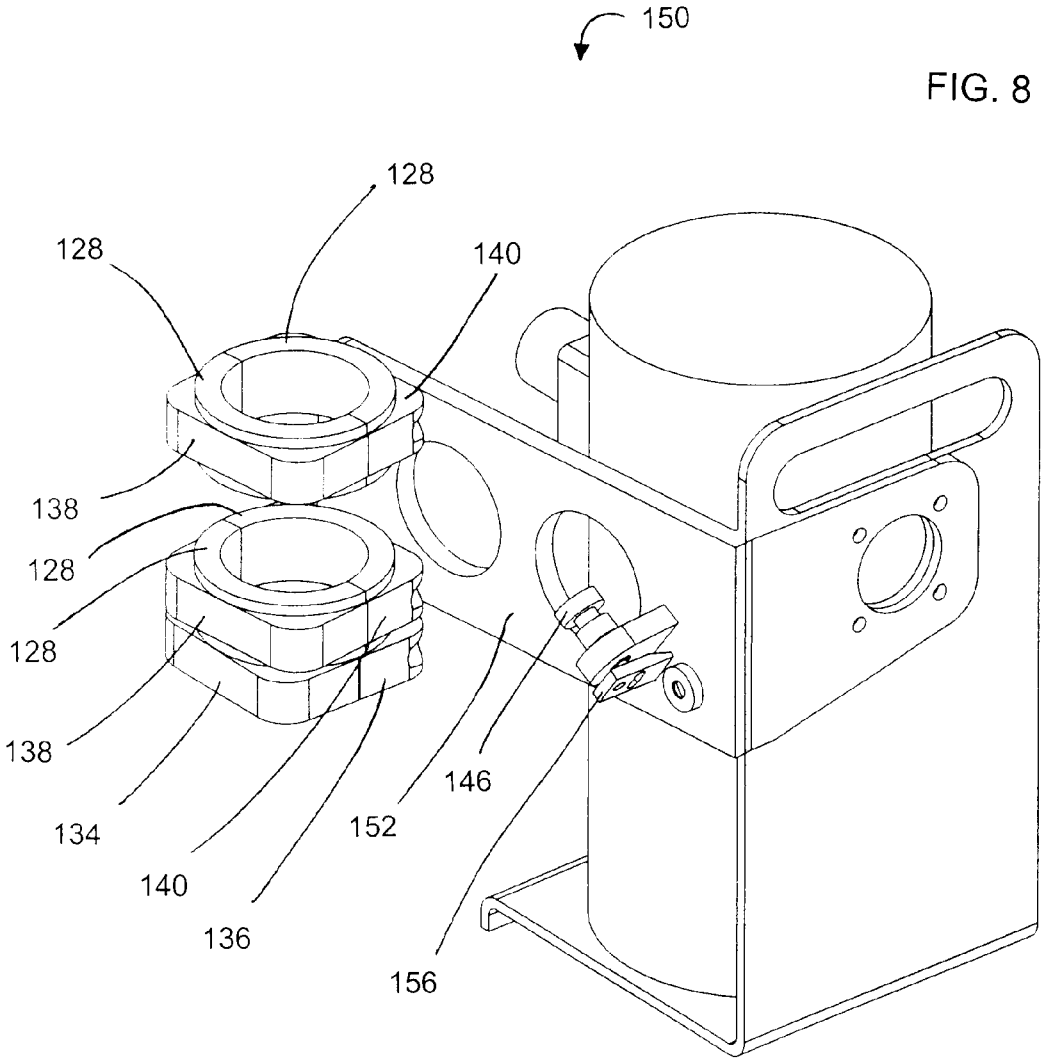
FIG. 8 is a perspective view of the drawover assembly mount of the preferred embodiment of the mobile medical emergency and surgical table of the present invention.

Details of drawover-type assembly mount 150 best may be seen with reference to FIG. 8. Drawover assembly mount comprises mount bar 152, fixed clamps 134, 136 and pivot clamps 138, 140, clamp bushings 128, striker catch 156, and plunger 146. In this manner, drawover assembly mount 150 may be affixed to frame 101 and can thereby rotate about the y-axis.

It will be apparent to those ordinarily skilled in the art that other similarly operating mounts as have been hereinabove described may be provided to accommodate such additional and further equipment and surgical implements as may be useful or desireable, and, thereby, to affix them to the frame 101. Additionally, other similarly configured cassettes as have been hereinabove described may be provided to further effectuate those purposes described for them hereinabove. All such modifications as are within the scope of the above disclosure, and that operate in a similar manner to achieve a hereinabove described purpose, are intended to be covered hereby.

Having thus described exemplary embodiments of the present invention, it should be noted by those ordinarily skilled in the art that the within disclosures are exemplary only, and that various other alternatives, adaptations, and modifications may be made within the scope of the present invention. Accordingly, the present invention is not limited to the specific embodiments as illustrated herein, but is limited only by the following claims.

I claim:

1. A mobile medical emergency and surgical table comprising:

(a.) a frame;

(b.) a stretcher yoke assembly, said stretcher yoke assembly being closeable to a stretcher restraining position upon introduction of a stretcher pole, and openable into a stretcher receiving position upon removal of the stretcher pole; and, (c.) an undercarriage assembly, wherein said undercarriage assembly is operable between a first position, wherein a plurality of wheels are deployed in order to roll upon a surface, and a second position, wherein said plurality of wheels are retracted in order not to roll upon said surface.

2. The mobile medical emergency and surgical table of claim 1 wherein said frame comprises a rigid structure that is sufficiently strong to enable a plurality of mobile medical emergency and surgical tables to be vertically stacked without crushing.

3. The mobile medical emergency and surgical table of claim 1 further comprising a table surface disposed upon said frame and suitable for resting a person thereupon.

4. The mobile medical emergency and surgical table of claim 3 wherein said table surface comprises a profile suitable to confine and channel liquids into a drain pipe.

5. The mobile medical emergency and surgical table of claim 1 wherein said undercarriage assembly is mechanically advantaged by lever arm means for operating a connecting bar to move a caster support between said first position and said second position for ease of operation.

6. The mobile medical emergency and surgical table of claim 1 wherein said undercarriage assembly comprises a pair of wheels mounted in a common plane to a caster support.

7. The mobile medical emergency and surgical table of claim 1 wherein said undercarriage assembly further provides for the substantially simultaneous lowering in parallel of two corners of said frame.

8. The mobile medical emergency and surgical table of claim 1 wherein said yoke assembly may be adjusted in vertical height in order to allow the position of said yoke to accommodate various surgical procedures.

9. The mobile medical emergency and surgical table of claim 1 wherein a stretcher carrying portion of said yoke assembly may be retracted into a second position whereupon said stretcher carrying portion does not interfere with the stacking of said tables one upon another.

10. The mobile medical emergency and surgical table of claim 1 further comprising a plurality of storage cassettes.

11. The mobile medical emergency and surgical table of claim 10 wherein said storage cassettes are side-accessible with respect to said frame.

12. The mobile medical emergency and surgical table of claim 10 wherein at least two of said plurality of storage cassettes are sized so as to be interchangeable in position with respect to said frame.

13. The mobile medical emergency and surgical table of claim 10 wherein at least one of said storage cassettes optionally may comprise a single drawer, multiple drawers, a net, a gas canister rack, or combinations thereof.

14. The mobile medical emergency and surgical table of claim 1 further comprising a mount for the attachment of medical and surgical equipment.

15. The mobile medical emergency and surgical table of claim 1 wherein said mount comprises a slide rail for holding clamping devices.

16. The mobile medical emergency and surgical table of claim 1 further comprising an electrical subsystem.

17. A mobile medical emergency and surgical table comprising:

(a.) a frame;

(b.) an undercarriage assembly, said undercarriage assembly being mechanically advantaged by lever arm means for operating a connecting bar to move a caster support between two operable positions for ease of operation; and (c.) a plurality of storage cassettes.

18. The mobile medical emergency and surgical table of claim 17 wherein said frame comprises a rigid structure that is sufficiently strong to enable a plurality of mobile medical emergency and surgical tables to be vertically stacked without crushing.

19. The mobile medical emergency and surgical table of claim 17 further comprising a table surface disposed upon said frame and suitable for resting a person thereupon.

20. The mobile medical emergency and surgical table of claim 19 wherein said table surface comprises a profile suitable to confine and channel liquids into a drain pipe.

21. The mobile medical emergency and surgical table of claim 17 wherein said undercarriage assembly is operable between a first position, wherein a plurality of wheels are deployed in order to roll upon a surface, and a second position, wherein said plurality of wheels are retracted in order not to roll upon said surface.

22. The mobile medical emergency and surgical table of claim 17 wherein said undercarriage assembly comprises a pair of wheels mounted in a common plane to a castor support.

23. The mobile medical emergency and surgical table of claim 17 wherein said undercarriage assembly further provides for the substantially simultaneous lowering in parallel of two corners of said frame.

24. The mobile medical emergency and surgical table of claim 17 further comprising a yoke assembly.

25. The mobile medical emergency and surgical table of claim 24 wherein said yoke assembly is closeable to a stretcher restraining position upon introduction of a stretcher pole, and openable into a stretcher receiving position upon removal of a stretcher pole.

26. The mobile medical emergency and surgical table of claim 24 wherein said yoke assembly may be adjusted in vertical height in order to allow the position of said yoke to accommodate various surgical procedures.

27. The mobile medical emergency and surgical table of claim 24 wherein a stretcher carrying portion of said yoke assembly may be retracted into a second position whereupon said stretcher carrying portion does not interfere with the stacking of said table upon another similar table.

28. The mobile medical emergency and surgical table of claim 17 wherein said storage cassettes are side-accessible with respect to said frame.

29. The mobile medical emergency and surgical table of claim 17 wherein at least two of said plurality of storage cassettes are sized so as to be interchangeable in position with respect to said frame.

30. The mobile medical emergency and surgical table of claim 17 wherein at least one of said storage cassettes optionally may comprise a single drawer, multiple drawers, a net, a gas canister rack, or combinations thereof.

31. The mobile medical emergency and surgical table of claim 17 further comprising a mount for the attachment of medical and surgical equipment.

32. The mobile medical emergency and surgical table of claim 31 wherein said mount comprises a slide rail for holding clamping devices.

33. The mobile medical emergency and surgical table of claim 17 further comprising an electrical subsystem.

34. A mobile medical emergency and surgical table comprising:

(a.) a frame;

(b.) an undercarriage assembly, said undercarriage assembly being mechanically advantaged by lever arm means for operating a connecting bar to move a caster support between two operable positions for ease of operation;

(c.) a stretcher yoke assembly, said stretcher yoke assembly being closeable to a stretcher restraining position upon introduction of a stretcher pole, and openable into a stretcher receiving position upon removal of the stretcher pole; and, (d.) a plurality of storage cassettes.

35. The mobile medical emergency and surgical table of claim 34 wherein said frame comprises a rigid structure that is sufficiently strong to enable a plurality of mobile medical emergency and surgical tables to be vertically stacked without crushing.

36. The mobile medical emergency and surgical table of claim 34 further comprising a table surface disposed upon said frame and suitable for resting a person thereupon.

37. The mobile medical emergency and surgical table of claim 36 wherein said table surface comprises a profile suitable to confine and channel liquids into a drain pipe.

38. The mobile medical emergency and surgical table of claim 34 where in s aid undercarriage assembly is operable between a first position, wherein a plurality of wheels are deployed in order to roll upon a surface, and a second position, wherein said plurality of wheels are retracted in order not to roll upon said surface.

39. The mobile medical emergency and surgical table of claim 34 wherein said undercarriage assembly comprises a pair of wheels mounted in a common plane to a castor support.

40. The mobile medical emergency and surgical table of claim 34 wherein said undercarriage assembly further provides for the substantially simultaneous lowering in parallel of two corners of said frame.

41. The mobile medical emergency and surgical table of claim 34 wherein said yoke assembly may be adjusted in vertical height in order to allow the position of said yoke to accommodate various surgical procedures.

42. The mobile medical emergency and surgical table of claim 34 wherein a stretcher carrying portion of said yoke assembly may be retracted into a second position whereupon said stretcher carrying portion does not interfere with the stacking of said tables one upon another.

43. The mobile medical emergency and surgical table of claim 34 wherein said storage cassettes are side-accessible with respect to said frame.

44. The mobile medical emergency and surgical table of claim 34 wherein at least two of said plurality of storage cassettes are sized so as to be interchangeable in position with respect to said frame.

45. The mobile medical emergency and surgical table of claim 34 wherein at least one of said storage cassettes optionally may comprise a single drawer, multiple drawers, a net, a gas canister rack, or combinations thereof.

46. The mobile medical emergency and surgical table of claim 34 further comprising a mount for the attachment of medical and surgical equipment.

47. The mobile medical emergency and surgical table of claim 46 wherein said mount comprises a slide rail for holding clamping devices.

48. The mobile medical emergency and surgical table of claim 34 further comprising an electrical subsystem.

49. A mobile medical emergency and surgical table comprising:

(a.) a frame;

(b.) an undercarriage assembly, said undercarriage assembly being mechanically advantaged by lever arm means for operating a connecting bar to move a caster support between two operable positions for ease of operation;

(c.) a stretcher yoke assembly, said stretcher yoke assembly being closeable to a stretcher restraining position upon introduction of a stretcher pole, and openable into a stretcher receiving position upon removal of the stretcher pole;

(d.) a plurality of storage cassettes; and, (e.) an optional mount for the attachment of medical and surgical equipment.

50. The mobile medical emergency and surgical table of claim 49 wherein said frame comprises a rigid structure that is sufficiently strong to enable a plurality of mobile medical emergency and surgical tables to be vertically stacked without crushing.

51. The mobile medical emergency and surgical table of claim 49 further comprising a table surface disposed upon said frame and suitable for resting a person thereupon.

52. The mobile medical emergency and surgical table of claim 51 wherein said table surface comprises a profile suitable to confine and channel liquids into a drain pipe.

53. The mobile medical emergency and surgical table of claim 49 wherein said undercarriage assembly is operable between a first position, wherein a plurality of wheels are deployed in order to roll upon a surface, and a second position, wherein said plurality of wheels are retracted in order not to roll upon said surface.

54. The mobile medical emergency and surgical table of claim 49 wherein said undercarriage assembly comprises a pair of wheels mounted in a common plane to a castor support.

55. The mobile medical emergency and surgical table of claim 49 wherein said undercarriage assembly further provides for the substantially simultaneous lowering in parallel of two corners of said frame.

56. The mobile medical emergency and surgical table of claim 49 wherein said yoke assembly may be adjusted in vertical height in order to allow the position of said yoke to accommodate various surgical procedures.

57. The mobile medical emergency and surgical table of claim 49 wherein a stretcher carrying portion of said yoke assembly may be retracted into a second position whereupon said stretcher carrying portion does not interfere with the stacking of said tables one upon another.

58. The mobile medical emergency and surgical table of claim 49 wherein at least two of said plurality of storage cassettes are sized so as to be interchangeable in position with respect to said frame.

59. The mobile medical emergency and surgical table of claim 49 wherein at least one of said storage cassettes optionally may comprise a single drawer, multiple drawers, a net, a gas canister rack, or combinations thereof.

60. The mobile medical emergency and surgical table of claim 49 wherein said mount comprises a slide rail for holding clamping devices.

61. The mobile medical emergency and surgical table of claim 49 further comprising an electrical subsystem.

62. A mobile medical emergency and surgical table comprising:

(a.) a frame assembly, said frame assembly carrying a table surface suitable for resting a person thereupon;

(b.) a pair of undercarriage assemblies, each of said undercarriage assemblies being operable between a first position, wherein a plurality of wheels in a substantially common plane are deployed in order to roll upon a surface, and a second position, wherein said plurality of wheels are retracted in order not to roll upon said surface;

(c.) a plurality of stretcher yoke assemblies, each of said stretcher yoke assemblies being closeable to a stretcher restraining position upon introduction of a stretcher pole, and openable into a stretcher receiving position upon removal of a stretcher pole;

(d.) a plurality of storage cassettes;

(e.) an electrical subsystem; and, (f.) an optional mount for the attachment of medical and surgical equipment.

63. The mobile medical emergency and surgical table of claim 62 wherein each of said undercarriage assemblies are mechanically advantaged by lever arm means for operating a connecting bar to move a caster support between two operable positions for ease of operation.

64. The mobile medical emergency and surgical table of claim 62 wherein each of said undercarriage assemblies further provide for the substantially simultaneous lowering in parallel of two corners of said frame.

65. The mobile medical emergency and surgical table of claim 62 wherein each of said yoke assemblies may be adjusted in vertical height in order to allow the position of said yoke to accommodate various surgical procedures.

66. The mobile medical emergency and surgical table of claim 62 wherein a stretcher carrying portion of each of said yoke assemblies may be retracted into a second position whereupon said stretcher carrying portion does not interfere with the stacking of said tables one upon another.

67. The mobile medical emergency and surgical table of claim 62 wherein at least two of said plurality of storage cassettes are sized so as to be interchangeable in position with respect to said frame.

68. The mobile medical emergency and surgical table of claim 62 wherein at least one of said storage cassettes optionally may comprise a single drawer, multiple drawers, a net, a gas canister rack, or combinations thereof.

69. The mobile medical emergency and surgical table of claim 62 wherein said mount comprises a slide rail for holding clamping devices.

* * * * *

UNITED STATES PATENT AND TRADEMARK OFFICE

CERTIFICATE OF CORRECTION

PATENT NO. : 6,546,577 B1
DATED : April 15, 2003
INVENTOR(S) : James Chinn

It is certified that error appears in the above-identified patent and that said Letters Patent is hereby corrected as shown below:

Title page,
Above Item [57], ABSTRACT, insert Item:

-- [74] *Attorney, Agent, or Firm*, Barry E. Kaplan, Myers & Kaplan Intellectual Property Law, L.L.C. --

Signed and Sealed this

Twenty-second Day of June, 2004

JON W. DUDAS
*Acting Director of the United States Patent and Trademark Office*